US008936253B1

(12) United States Patent
Rizzi

(10) Patent No.: US 8,936,253 B1
(45) Date of Patent: Jan. 20, 2015

(54) RESCUE SLED SYSTEMS

(76) Inventor: Thomas J. Rizzi, Marana, AZ (US)

( * ) Notice: Subject to any disclaimer, the term of this patent is extended or adjusted under 35 U.S.C. 154(b) by 265 days.

(21) Appl. No.: 13/469,972

(22) Filed: May 11, 2012

Related U.S. Application Data

(60) Provisional application No. 61/486,249, filed on May 14, 2011, provisional application No. 61/536,521, filed on Sep. 19, 2011.

(51) Int. Cl.
*A61G 1/013* (2006.01)

(52) U.S. Cl.
USPC ..... 280/20; 280/17; 280/19; 5/627; 5/628

(58) Field of Classification Search
CPC . A61G 1/0562; A61G 1/0237; A61G 1/0225; A61G 1/044; A61G 1/01; A61G 1/013; A61G 1/017; A61G 1/00
USPC ..... 280/19, 400, 15, 17, 18, 19.1, 20; 5/625, 626, 627, 628
See application file for complete search history.

(56) References Cited

U.S. PATENT DOCUMENTS 1,656,701 A * 1/1928 Eustace ..... 280/47.34
2,201,890 A 5/1940 Dunn
2,511,061 A * 6/1950 Hughes ..... 5/627
2,947,007 A * 8/1960 Oades ..... 5/627
3,088,128 A 5/1963 Waddington
3,135,972 A 6/1964 Jakes et al.
3,271,796 A * 9/1966 Dillman ..... 5/625
3,336,060 A 8/1967 Bradford
3,417,412 A * 12/1968 Andrews ..... 5/627
3,449,776 A * 6/1969 Brock ..... 5/627
3,577,573 A * 5/1971 Mrnak ..... 5/627
3,648,305 A * 3/1972 Ersek ..... 378/180
3,797,051 A * 3/1974 Evans ..... 5/627
3,886,606 A * 6/1975 Bradford ..... 5/627
4,124,908 A 11/1978 Burns et al.
4,151,842 A * 5/1979 Miller ..... 602/19
4,216,556 A * 8/1980 Haeussinger ..... 5/627
4,283,068 A 8/1981 Keyser
4,442,557 A 4/1984 Clemens
4,579,381 A * 4/1986 Williams ..... 296/20
4,736,474 A 4/1988 Moran et al.
4,783,862 A * 11/1988 Murphy ..... 5/81.1 T
4,922,562 A * 5/1990 Allred et al. ..... 5/627
4,970,739 A * 11/1990 Bradford ..... 5/625
4,977,630 A * 12/1990 Oswalt et al. ..... 5/632
5,014,374 A * 5/1991 Williams ..... 5/628
5,023,968 A * 6/1991 Diehl et al. ..... 5/81.1 R
5,044,031 A * 9/1991 Sherwood et al. ..... 2/69.5
5,195,944 A * 3/1993 Schlogel ..... 602/5
5,211,186 A * 5/1993 Shoemaker et al. ..... 5/628
5,253,885 A * 10/1993 McCracken et al. ..... 280/20
5,263,213 A * 11/1993 Robertson et al. ..... 5/627
5,306,026 A * 4/1994 Jesse ..... 280/18

(Continued)

*Primary Examiner* — Brodie Follman
(74) *Attorney, Agent, or Firm* — Lodestar Patents, PLLC; Raymond J. E. Hall

(57) ABSTRACT

A system related to providing a rescue sled vehicle to move an injured or wounded person from a hostile 'battlefield condition' environment to a safer environment for medical triage. The rescue sled comprises flexible hinged sections allowing for serpentine movement as well as vertical flexible movement to assist in rescue operations needing extraction from almost any type of structure or environment, particularly narrow areas and/or sloped ground/stairs. Further, the rescue sled is single rescuer carryable while providing the rescuer hands-free operation during entrance and exit operations.

15 Claims, 13 Drawing Sheets

(56) References Cited

U.S. PATENT DOCUMENTS

| | | | | |
|---|---|---|---|---|
| 5,320,567 | A | 6/1994 | Beer | |
| 5,375,277 | A * | 12/1994 | Carr et al. | 5/625 |
| 5,499,416 | A | 3/1996 | Daouk | |
| 5,502,854 | A | 4/1996 | Daouk | |
| 5,515,549 | A * | 5/1996 | Wang | 5/625 |
| 5,618,051 | A * | 4/1997 | Kobylenski et al. | 280/14.21 |
| 5,720,303 | A | 2/1998 | Richardson | |
| 5,826,583 | A * | 10/1998 | Wood | 128/869 |
| 5,839,137 | A * | 11/1998 | Butler et al. | 5/627 |
| 6,006,968 | A * | 12/1999 | McCarthy et al. | 224/184 |
| 6,053,534 | A * | 4/2000 | Timmerman | 280/845 |
| 6,055,988 | A * | 5/2000 | Perisho | 128/869 |
| 6,062,930 | A * | 5/2000 | Smith | 441/129 |
| 6,154,902 | A * | 12/2000 | Russillio et al. | 5/623 |
| 6,477,728 | B1 * | 11/2002 | Faz | 5/625 |
| 6,604,747 | B2 * | 8/2003 | Moore | 280/20 |
| 6,634,044 | B1 | 10/2003 | Wright | |
| 6,772,764 | B2 * | 8/2004 | Chapman | 128/870 |
| 6,851,145 | B2 | 2/2005 | Smith et al. | |
| 6,860,272 | B2 * | 3/2005 | Carter et al. | 128/870 |
| 6,871,368 | B2 * | 3/2005 | Calkin | 5/628 |
| 6,883,195 | B1 | 4/2005 | Gustavsen | |
| 7,043,785 | B2 | 5/2006 | Dimentmen | |
| 7,065,814 | B2 * | 6/2006 | Rutkowski | 5/655 |
| 7,082,632 | B2 | 8/2006 | Hood | |
| 7,100,226 | B1 * | 9/2006 | Walton | 5/626 |
| 7,100,927 | B2 * | 9/2006 | Krent | 280/16 |
| 7,302,723 | B2 | 12/2007 | Dean | |
| 7,394,387 | B2 | 7/2008 | Noonchester | |
| 7,422,220 | B2 | 9/2008 | Walkingshaw et al. | |
| 7,530,126 | B2 | 5/2009 | Thompson et al. | |
| 7,549,661 | B2 | 6/2009 | Jackson et al. | |
| 7,607,184 | B1 | 10/2009 | Goodner, Jr. | |
| 7,810,820 | B2 * | 10/2010 | Wolf et al. | 280/19 |
| 7,818,840 | B2 | 10/2010 | Barnett et al. | |
| 7,861,341 | B2 * | 1/2011 | Ayette et al. | 5/621 |
| 7,904,979 | B2 * | 3/2011 | Walke et al. | 5/706 |
| 8,001,634 | B2 * | 8/2011 | Ayette et al. | 5/621 |
| 8,333,392 | B1 * | 12/2012 | Wolf et al. | 280/19 |
| 8,336,141 | B2 * | 12/2012 | Wong | 5/627 |
| 8,365,326 | B2 * | 2/2013 | Kenalty et al. | 5/628 |
| 8,590,077 | B2 * | 11/2013 | Saunders et al. | 5/628 |
| 2002/0153680 | A1 * | 10/2002 | Moore | 280/20 |
| 2002/0162171 | A1 * | 11/2002 | Faz | 5/627 |
| 2004/0010852 | A1 * | 1/2004 | Bourgraf, Jr. | 5/627 |
| 2004/0088794 | A1 * | 5/2004 | Calkin | 5/628 |
| 2004/0128767 | A1 | 7/2004 | Hood | |
| 2005/0212230 | A1 * | 9/2005 | Krent | 280/15 |
| 2006/0061050 | A1 | 3/2006 | Wolf et al. | |
| 2007/0136950 | A1 * | 6/2007 | Zuercher | 5/627 |
| 2007/0180625 | A1 * | 8/2007 | Walke et al. | 5/706 |
| 2008/0134436 | A1 * | 6/2008 | Beaudry et al. | 5/627 |
| 2008/0168603 | A1 * | 7/2008 | Ayette et al. | 5/628 |
| 2008/0184488 | A1 * | 8/2008 | Fee et al. | 5/628 |
| 2008/0265557 | A1 * | 10/2008 | Walkingshaw et al. | 280/845 |
| 2009/0038076 | A1 * | 2/2009 | Giduck | 5/627 |
| 2009/0313759 | A1 * | 12/2009 | Wong | 5/627 |
| 2010/0005593 | A1 * | 1/2010 | Bowling et al. | 5/627 |
| 2010/0176619 | A1 | 7/2010 | Cahaan | |
| 2010/0243372 | A1 * | 9/2010 | Wilkinson | 182/3 |
| 2011/0056022 | A1 * | 3/2011 | Ayette et al. | 5/621 |
| 2011/0120478 | A1 * | 5/2011 | Thompson et al. | 128/870 |
| 2011/0185504 | A1 * | 8/2011 | Kenalty et al. | 5/626 |
| 2011/0220695 | A1 * | 9/2011 | Saunders et al. | 224/158 |
| 2012/0272451 | A1 * | 11/2012 | Haskell et al. | 5/628 |
| 2013/0139319 | A1 * | 6/2013 | Kenalty et al. | 5/628 |

* cited by examiner

RESCUE SLED SYSTEMS

CROSS-REFERENCE TO RELATED APPLICATION

The present application is related to and claims priority from prior provisional application Ser. No. 61/486,249, filed May 14, 2011, entitled "RESCUE SLED SYSTEMS"; and, this application is related to and claims priority from prior provisional application Ser. No. 61/536,521, filed Sep. 19, 2011, entitled "RESCUE SLED SYSTEMS, the contents of all of which are incorporated herein by this reference and are not admitted to be prior art with respect to the present invention by the mention in this cross-reference section.

BACKGROUND

This invention relates to providing a system relating to improved emergency transport. More particularly, this invention relates to providing a vehicle rescue sled system for at least moving an injured or wounded person from a hostile 'battlefield condition' environment to a safer environment.

There are many scenarios when a person has been incapacitated, wounded or severely injured, so as not to be self-mobile and, wherein such a person continues to be in harm's way. Such scenarios as above are particularly evident on the military battlefield as well as in domestic situations involving firearms; both scenarios involving a continuing potentially dangerous and hostile environment. It would be very useful to have a means for removing and transporting such incapacitated, wounded or severely injured persons to a safer environment for medical treatment. It would also be very useful for such transport to be easily carried by at least one single rescue individual into such hostile environment, and further, to allow such rescuer to have use of his/her hands during transport. Even further, it would be very useful for such transport to assist rescue where narrow structures and/or hills, stairs, and other uneven surfaces are present.

OBJECTS AND FEATURES OF THE INVENTION

A primary object and feature of the present invention is to provide a system overcoming the above-mentioned problem(s).

It is a further object and feature of the present invention to provide such a system providing at least a rescue sled easily transported by a single individual into a hostile environment and capable of assisting transport of a wounded person out of such hostile environment by such single individual.

It is a further object and feature of the present invention to provide such a system assisting hands-free sled transport.

It is a further object and feature of the present invention to provide such a system that is retractable into a single-carry stowed portion and deployable into a single-carry single-person-deployable rescue sled.

It is a further object and feature of the present invention to provide such a system providing at least a rescue sled comprising segmented sections having fabric hinges structured and arranged to allow multiple axis movement (vertically and serpentine) to facilitate rescue sled entrance and escape in cramped environments.

It is a further object and feature of the present invention to provide such a system providing at least a rescue sled easily transported by one individual into a hostile environment and capable of assisting multiple person transport of at least one wounded person out of such hostile environment by such individuals.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a rescue sled system, relating to transport by at least one rescuer of at least one incapacitated person in at least one environment under emergency conditions, comprising: at least one support provider, having a plurality of segments, structured and arranged to provide at least one support for the at least one incapacitated person during transport; at least one segmental divider structured and arranged to divide such at least one support provider into such plurality of segments; at least one segmental serial connector structured and arranged to serially connect such plurality of segments; and at least one body securer structured and arranged to secure the at least one incapacitated person to such at least one support provider; wherein such plurality of segments serially connected comprise a series of single segments structured and arranged to allow geometric movement of a respective such single segment of such plurality of segments relative to adjacent such single segments in series. Moreover, it provides such a rescue sled system wherein such at least one support provider further comprises: at least one stability provider structured and arranged to provide longitudinal stability to such at least one support provider; wherein such at least one body securer and such at least one support provider, when coupled with the at least one incapacitated person, together comprise such at least one stability provider.

Additionally, it provides such a rescue sled system wherein such at least one support provider further comprises: at least one deployed configuration structured and arranged to support substantially a full body length of the at least one incapacitated person; and at least one stowed configuration comprising at least one reduced physical formation structured and arranged to assist body-supported transport of such at least one support provider; wherein at least one rescuer may body-supported transport such at least one support provider in such at least one stowed configuration, deploy such at least one support provider in such at least one deployed configuration and transport the at least one incapacitated person. Also, it provides such a rescue sled system further comprising: at least one forward pull strap structured and arranged to assist such transport of the at least one incapacitated person by the application of at least one pulling force on such at least one support provider; wherein such at least one forward pull strap comprises at least one first body engager structured and arranged to engage the body of at least one first rescuer to assist such pulling. In addition, it provides such a rescue sled system further comprising: at least one trailing lift strap structured and arranged to assist such transport of the at least one incapacitated person by the application of at least one lifting force on such at least one support provider; wherein such at least one trailing lift strap comprises at least one second body engager structured and arranged to engage the body of at least one second rescuer.

And, it provides such a rescue sled system wherein such plurality of segments further comprises: at least one leading segment associated with support of a head region of the at least one incapacitated person; at least one trailing segment associated with support of a foot region of the at least one incapacitated person; and at least one intermediate segment disposed between such at least one leading segment and such at least one trailing segment; wherein such at least one trailing segment is configured to be arrangeable in at least one compact nested position adjacent such at least one intermediate segment; wherein such at least one intermediate segment is configured to be arrangeable in at least one compact nested position adjacent such at least one leading segment; and wherein when such at least one trailing segment is in at least one compact nested position adjacent such at least one intermediate segment and, such at least one intermediate segment is in the at least one compact nested position adjacent such at least one leading segment, such at least one stowed configuration is achieved. Further, it provides such a rescue sled system wherein such at least one segmental serial connector comprises at least one multi-axis pivot structured and arranged to assist pivoting of adjacent such segments around at least one first axis and at least one second axis.

Even further, it provides such a rescue sled system wherein: such at least one multi-axis pivot is structured and arranged to assist pivoting of adjacent such segments around at least one first axis in at least one first direction; and such at least one multi-axis pivot is structured and arranged to assist pivoting of adjacent such segments around at least one second axis in at least one second direction; and such at least one first direction is non-parallel to such at least one second direction. Moreover, it provides such a rescue sled system wherein: such at least one multi-axis pivot comprises at least one flexible strap structured and arranged to flexibly couple adjacent such segments; and such at least one flexible strap at least serially connects adjacent such segments. Additionally, it provides such a rescue sled system wherein such at least one flexible strap comprises seat-belt strength flexible strap. Also, it provides such a rescue sled system wherein: such at least one flexible strap is structured and arranged to permanently connect such segments; and each of such segments remains independently moveable relative to each other such segment when coupled. In addition, it provides such a rescue sled system wherein such at least one flexible strap is structured and arranged to form at least one overlap portion between adjacent such segments to assist such at least one support provider to provide support continuity. And, it provides such a rescue sled system wherein such least one support provider comprises four such segments, each such segments decreasing in transverse width from such at least one leading segment to such at least one trailing segment. Further, it provides such a rescue sled system wherein: each such segment is arranged to overlap, and be partially supported by, a proceeding adjacent such segments; and such segments are overlapped in an orientation assisting sliding of such segments during transport of the at least one incapacitated person when pulled by such at least one leading segment.

Even further, it provides such a rescue sled system wherein: such at least one forward pull strap is coupled to such at least one leading segment; and such at least one trailing lift strap is coupled to such at least one trailing segment. Moreover, it provides such a rescue sled system wherein at least one body securer further comprises at least one pair of opposed upwardly projecting lateral walls structured and arranged to assist retention of the at least one incapacitated person during such transport. Additionally, it provides such a rescue sled system wherein at least one body securer further comprises: at least one body strap structured and arranged to strap at least the torso of the at least one incapacitated person; and at least one foot strap structured and arranged to strap at least one lower leg portion of the at least one incapacitated person. Also, it provides such a rescue sled system wherein: such at least one leading segment comprises one leading segment; such one leading segment comprises a longitudinal length of about twenty-one inches and a traverse width of about seventeen inches; such at least one intermediate segment comprises a first intermediate segment and a second intermediate segment; such first intermediate segment comprises a longitudinal length of about twenty-one inches and a traverse width of about sixteen inches; such second intermediate segment comprises a longitudinal length of about twenty-one inches and a traverse width of about fifteen inches; such at least one trailing segment comprises one trailing segment; such one trailing segment comprises a longitudinal length of about twenty-one inches and a traverse width of about fourteen inches.

In accordance with another preferred embodiment hereof, this invention provides a rescue sled system, relating to transport by at least one rescuer of at least one incapacitated person in at least one environment under emergency conditions, comprising: at least one support provider, having a plurality of segments, structured and arranged to provide at least one support for the at least one incapacitated person during transport; at least one segmental divider structured and arranged to divide such at least one support provider into such plurality of segments; at least one segmental serial connector structured and arranged to serially connect such plurality of segments; and at least one body securer structured and arranged to secure the at least one incapacitated person to such at least one support provider; wherein such plurality of segments comprises a series of single segments structured and arranged to allow geometric movement of a single segment of such plurality of segments relative to adjacent such single segments in series. wherein such at least one support provider further comprises at least one deployed configuration structured and arranged to support substantially a full body length of the at least one incapacitated person, and at least one stowed configuration comprising at least one reduced physical formation structured and arranged to assist body-supported transport of such at least one support provider; wherein at least one rescuer may body-supported transport such at least one support provider in such at least one stowed configuration, deploy such at least one support provider in such at least one deployed configuration and transport the at least one incapacitated person; at least one forward pull strap structured and arranged to assist such transport of the at least one incapacitated person by the application of at least one pulling force on such at least one support provider; wherein such at least one forward pull strap comprises at least one first body engager structured and arranged to engage the body of at least one first rescuer to assist such pulling; at least one trailing lift strap structured and arranged to assist such transport of the at least one incapacitated person by the application of at least one lifting force on such at least one support provider; wherein such at least one trailing lift strap comprises at least one second body engager structured and arranged to engage the body of at least one second rescuer; wherein such plurality of segments further comprises at least one leading segment associated with support of a head region of the at least one incapacitated person, at least one trailing segment associated with support of a foot region of the at least one incapacitated person, at least one intermediate segment disposed between such at least one leading segment and such at least one trailing segment, wherein such at least one trailing segment is configured to be arrangeable in at least one compact nested position adjacent such at least one intermediate segment, wherein such at least one intermediate segment is configured to be arrangeable in at least one compact nested position adjacent such at least one leading segment, and wherein when such at least one trailing segment is in at least one compact nested position adjacent such at least one intermediate segment and such at least one intermediate segment is in the at least one compact nested position adjacent such at least one leading segment, such at least one stowed configuration is achieved; and such at least one segmental serial connector comprises at least one multi-axis pivot structured and arranged to assist pivoting of adjacent such segments around at least one first axis and at least one second axis wherein such at least one multi-axis pivot is structured and arranged to assist pivoting of adjacent such segments around such at least one first axis; wherein such at least one multi-axis pivot is structured and arranged to assist pivoting of adjacent such segments around such at least one second axis; wherein such at least one second axis is non-parallel to such at least one first axis; wherein such at least one multi-axis pivot comprises at least one flexible strap structured and arranged to flexibly couple adjacent such segments; wherein such at least one flexible strap at least serially connects adjacent such segments; wherein such at least one flexible strap is structured and arranged to permanently connect such segments; and wherein each of such segments remains independently moveable relative to each other such segment when coupled. In addition, it provides such a rescue sled system wherein: such least one support provider comprises four such segments, each such segments decreasing in transverse width from such at least one leading segment to such at least one trailing segment; each such segment is arranged to overlap, and be partially supported by, a proceeding adjacent such segments; and such segments are overlapped in an orientation assisting sliding of such segments during transport of the at least one incapacitated person when pulled by such at least one leading segment.

And, it provides such a rescue sled system wherein: such at least one leading segment comprises one leading segment; such one leading segment comprises a longitudinal length of about twenty-one inches and a traverse width of about seventeen inches; such at least one intermediate segment comprises a first intermediate segment and a second intermediate segment; such first intermediate segment comprises a longitudinal length of about twenty-one inches and a traverse width of about sixteen inches; such second intermediate segment comprises a longitudinal length of about twenty-one inches and a traverse width of about fifteen inches; such at least one trailing segment comprises one trailing segment; and such one trailing segment comprises a longitudinal length of about twenty-one inches and a traverse width of about fourteen inches. Further, it provides such a rescue sled system wherein: such at least one forward pull strap is coupled to such at least one leading segment; and such at least one trailing lift strap is coupled to such at least one trailing segment. Even further, it provides such a rescue sled system wherein at least one body securer further comprises at least one pair of opposed upwardly projecting lateral walls structured and arranged to assist retention of the at least one incapacitated person when placed onto such at least one support provider. Even further, it provides such a rescue sled system wherein at least one body securer further comprises: at least one body strap structured and arranged to strap at least the torso of the at least one incapacitated person; and at least one foot strap structured and arranged to strap at least one lower leg portion of the at least one incapacitated person.

In accordance with another preferred embodiment hereof, this invention provides a rescue sled system, relating to transport by at least one rescuer of at least one incapacitated person in at least one environment under emergency conditions, comprising: support provider means, having a plurality of segments, for providing support for such at least one incapacitated person during transport; segmental divider means for dividing such support provider means into segments; geometry means for providing such segments as sheets; segmental serial connector means for serially connecting such segments; and body securer means for securing such at least one incapacitated person to such support provider means; wherein such plurality of segments comprises a series of single segments structured and arranged to allow geometric movement of a single segment of such plurality of segments relative to adjacent such single segments in series.

In accordance with other preferred embodiments hereof, this invention provides a rescue sled system comprising each and every novel feature, element, combination, step and/or method disclosed or suggested by this patent application.

DETAILED DESCRIPTION OF THE BEST MODES AND PREFERRED EMBODIMENTS OF THE INVENTION

Figures 1, 2, 3:
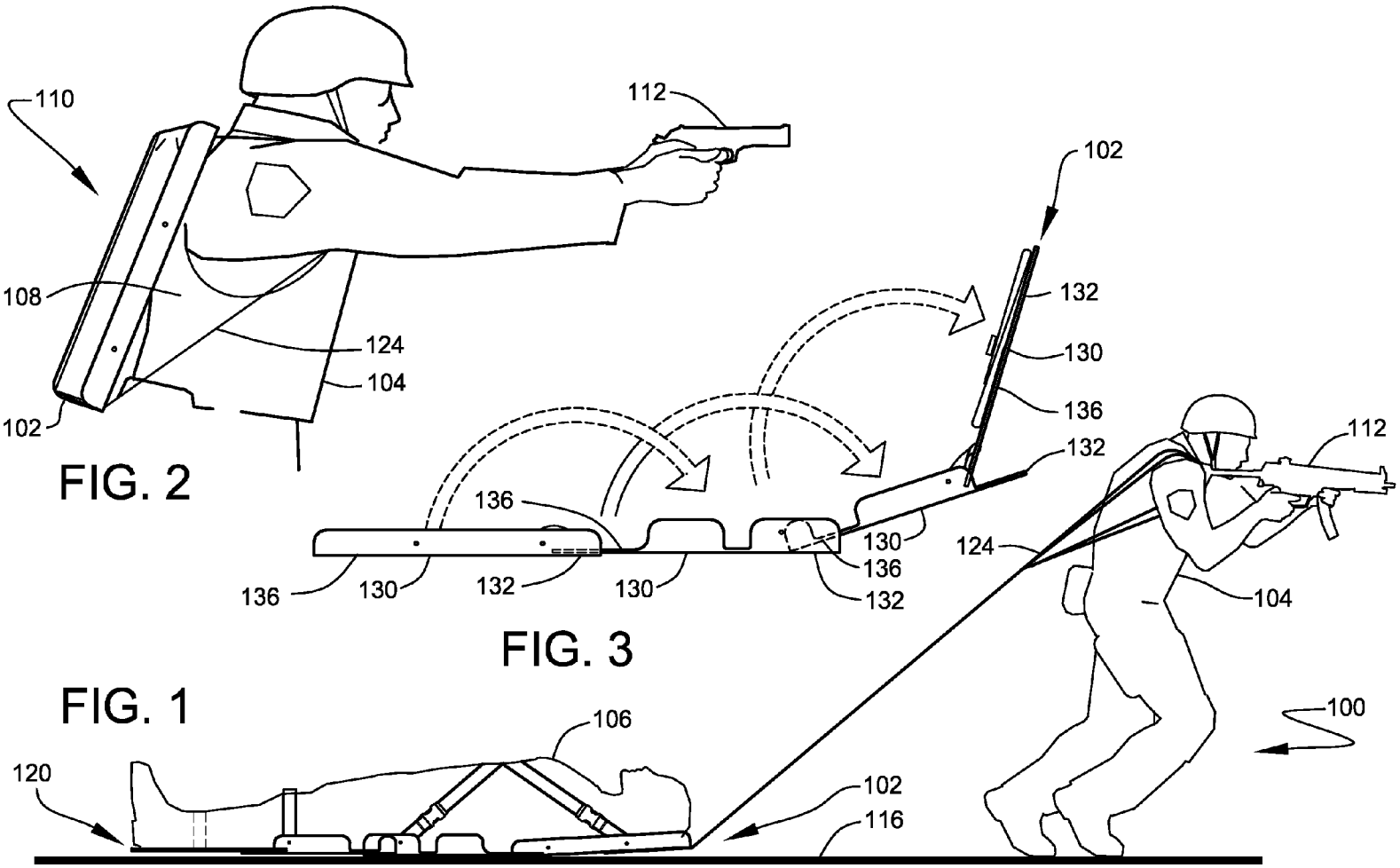
FIG. 1 shows a side view, illustrating a rescue sled of the rescue sled systems in a fully deployed position, according to a preferred embodiment of the present invention.
FIG. 2 shows a side view, illustrating the rescue sled in a fully stowed position, according to the preferred embodiment of FIG. 1.
FIG. 3 shows a side view, illustrating the rescue sled extending to a deployed position, according to the preferred embodiment of FIG. 1.

FIG. 1 shows a side view illustrating a rescue sled 102 of the rescue sled systems 100, in a fully deployed position 120, according to a preferred embodiment of the present invention. FIG. 2 shows a side view, illustrating the rescue sled 102, in a fully stowed position 110, according to the preferred embodiment of FIG. 1.

Rescue sled systems 100 preferably comprise at least one rescue sled 102, as shown. Rescue sled 102 preferably at least provides a transport means for removing and transporting incapacitated, wounded or injured person(s) 106 from a hostile environment to a safer environment preferably for at least emergency medical triage. Rescue sled 102 preferably at least provides a transporter to be easily carried by a single rescuer 104 into such hostile environment, and further, to allow such rescuer 104 to have use of his/her hands freely available during transport, to hold, for example at least one weapon 112. Upon reading this specification, those with ordinary skill in the art will now appreciate that, under appropriate circumstances, considering such issues as design preference, user preferences, marketing preferences, cost, structural requirements, available materials, technological advances, etc., other hand-usage arrangements such as, for example, holding a bullet-proof shield, etc., may suffice.

Preferably, in the fully stowed position 110 shown in FIG. 2, the rescue sled 102 is easily slung around the torso 108 using at least one carrying strap 124, preferably two carrying straps 124, by rescuer 104, preferably, in an over-one-shoulder and under-the-other-shoulder position, preferably carried along the back of rescuer 104, as shown. Alternately preferably, the rescue sled 102 is carried backpack style utilizing two carrying straps 124, one over each respective shoulder. Stowed position 110 (at least embodying herein at least one stowed configuration comprising at least one reduced physical formation structured and arranged to assist body-supported transport of said at least one support provider) and carrying strap 124 preferably assist rapid entry of rescuer 104 into such hostile area. Upon reading this specification, those with ordinary skill in the art will now appreciate that, under appropriate circumstances, considering such issues as design preference, user preferences, marketing preferences, cost, structural requirements, available materials, technological advances, etc., other carrying arrangements such as, for example, front carry, side carry, hip-carry, etc., may suffice.

Preferably, when in fully deployed position 120, rescue sled 102 assists rescuer 104 to transport at least one such incapacitated, wounded or injured person(s) 106 over at least one support surface 116, such as, for example, the ground, as shown. The above described arrangements at least embodying herein at least one deployed configuration structured and arranged to support substantially a full body length of the at least one incapacitated person; and at least embodying herein wherein at least one rescuer may body-supported transport said at least one support provider in said at least one stowed configuration, deploy said at least one support provider in said at least one deployed configuration and transport the at least one incapacitated person. Upon reading this specification, those with ordinary skill in the art will now appreciate that, under appropriate circumstances, considering such issues as design preference, user preferences, marketing preferences, cost, structural requirements, available materials, technological advances, etc., other support surfaces such as, for example, concrete, wood, stairs, tarmac, roofs, etc., may suffice.

FIG. 3 shows a side view, illustrating the rescue sled 102, extending to a deployed position 120, according to the preferred embodiment of FIG. 1. Rescue sled 102 preferably comprises a plurality of segmented sections 130 (at least one hiding herein support provider means, having a plurality of segments, for providing support for such at least one incapacitated person during transport; and, at least embodies herein at least one support provider, having a plurality of segments, structured and arranged to provide at least one support for the at least one incapacitated person during transport), preferably four segmented sections 130, as shown. Preferably, each respective segmented section 130 comprises a first end 132 and a second end 136, as shown. Preferably, each respective second end 136 overlaps a respective first end 132 of each respective segmented section 130, except for the first segment first end 132 and the last (fourth) segment second end 136, as shown; in such manner, rescue sled 102 may be quickly deployed, as shown (at least embodying herein wherein said at least one flexible strap is structured and arranged to form at least one overlap portion between adjacent said segments to assist said at least one support provider to provide support continuity). Further, the segmented sections 130 preferably provide for easily slidable, flexible transport over uneven surfaces and in limited space environments (at least embodying herein said segments are overlapped in an orientation assisting sliding of said segments during transport of the at least one incapacitated person when pulled by said at least one leading segment).

Figure 4:
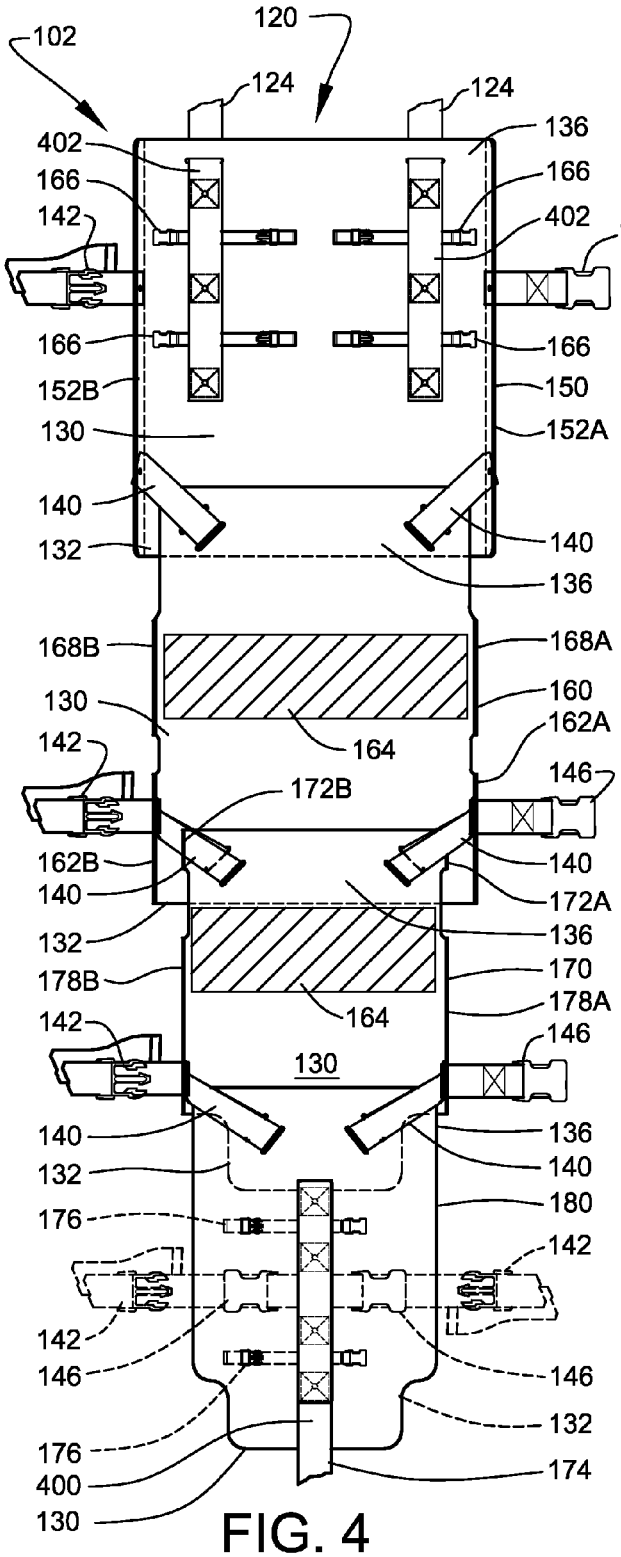
FIG. 4 shows a top view, illustrating the rescue sled in a deployed position, according to the preferred embodiment of FIG. 1.
Figure 5:
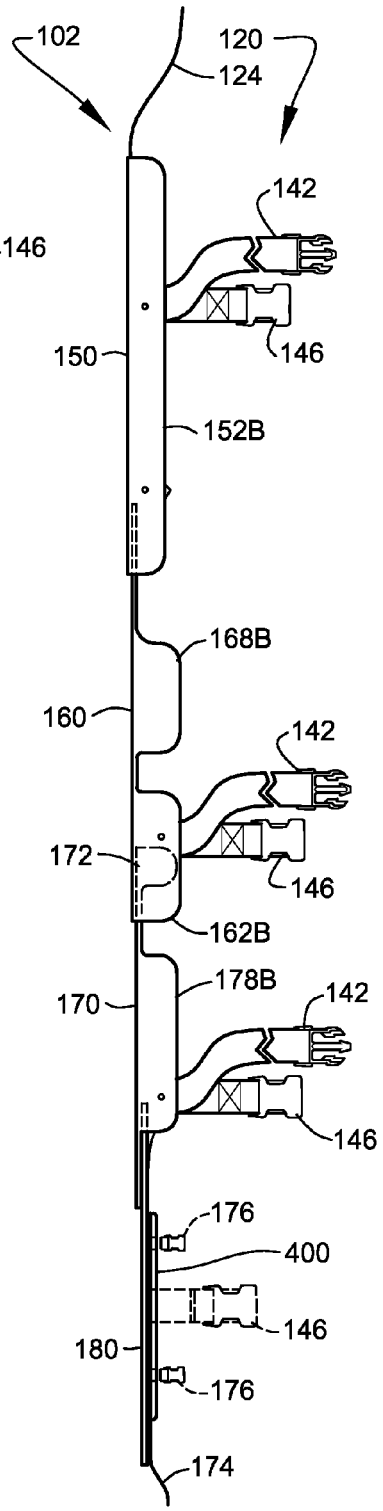
FIG. 5 shows a side view, illustrating the rescue sled, in a deployed position, according to the preferred embodiment of FIG. 1.

FIG. 4 shows a top view illustrating the rescue sled 102, in a deployed position 120, according to the preferred embodiment of FIG. 1. FIG. 5 shows a side view illustrating the rescue sled 102, in a deployed position 120, according to the preferred embodiment of FIG. 1.

As previously stated, rescue sled 102 preferably comprises a plurality of segmented sections 130, preferably four segmented sections 130, as shown. The preferred four segmented sections 130 preferably comprise at least a first section (head) 150, a second section (torso) 160, a third section (torso) 170, and a fourth section (leg) 180, as shown. The above arrangement at least embodies herein at least one segmental divider structured and arranged to divide said at least one support provider into said plurality of segments; and, at least embodies herein segmental divider means for dividing said support provider means into segments. Alternately preferably, the preferred four segmented sections 130 may be utilized in reverse order, that is, the head may be placed on the fourth section 180 and the feet along the first section 150 (preferably, whatever is necessary in an emergency situation for the rescuer to transport the injured person).

Further, three of the segmented sections 130 preferably comprise pairs of opposed (mirrored) side rails (except for fourth section (leg) 180). First section (head) 150 preferably comprises a single opposed pair of side rails 152A and 152B, as shown. Second section (torso) 160 comprises side rails 162A and 162B and 168A and 168B, as shown. Third section (torso) 170 comprises side rails 172A and 172B and 178A and 178B, as shown. The pairs of opposed (mirrored) side rails preferably assist keeping such incapacitated, wounded or injured person(s) 106 on the rescue sled 102, as well as provide limited protection of the body of such incapacitated, wounded or injured person(s) 106, as shown. The above described arrangements at least embodying herein wherein at least one body securer further comprises at least one pair of opposed upwardly projecting lateral walls structured and arranged to assist retention of the at least one incapacitated person during such transport.

Each respective segmented section 130 is preferably hinged to each respective adjacent segmented section 130, preferably loosely hinged, preferably using a pair of opposed straps 140 (at least embodying herein segmental serial connector means for serially connecting said segments; and, at least embodying herein at least one segmental serial connector structured and arranged to serially connect said plurality of segments), preferably at least seatbelt strength fabric straps, preferably about 1⅞ inch in width, as shown. The preferred arrangement of strapping and coupling will be further described below.

For example, first section (head) 150 is preferably coupled by straps 140 to second section (torso) 160 which is preferably coupled by straps 140 to third section (torso) 170 which is preferably coupled by straps 140 to fourth section (leg) 180, as shown. Each respective strap 140 preferably is about ten inches in total length, preferably threaded through a respective second end 136 (preferably through slotted openings 208, for example, as shown in FIG. 11B) so that a respective strap 140 is folded over into a five inch section and preferably through-bolted into a respective first end 132, and then through-bolted into a respective side rail portion, as shown (and described further below). All bolting herein preferably using about a ¾ to 1-inch bolt, preferably corrosion resistant, preferably stainless steel, with washers, also corrosion resistant, preferably stainless steel, situate adjacent the bolt head on one side of an aperture and a washer on the other side on the bolt, preferably adjacent the strap, finished by a threaded nut, preferably a locking nut. Further, bolting herein is structured and arranged to permanently connect said segments 130 while providing (by use of flexible strap couplers) each of said segments remains independently moveable relative to each other said segment when coupled.

Upon reading this specification, those with ordinary skill in the art will now appreciate that, under appropriate circumstances, considering such issues as design preference, user preferences, marketing preferences, cost, structural requirements, available materials, technological advances, etc., other strap 140 attachment arrangements such as, for example, adhesive(s), rivets, clamps, etc., may suffice.

Preferably, a plurality of male couplers 142 and female couplers 146 are installed along with a respective length of restraining strapping on respective segmented sections 130 along the rescue sled 102, preferably to assist re-straining an incapacitated, wounded or injured person(s) 106, as shown (this arrangement at least embodying herein body securer means for securing such at least one incapacitated person to said support provider means; and, at least embodying herein at least one body securer structured and arranged to secure the at least one incapacitated person to said at least one support provider). Preferably, each male coupler 142 will couple with each female coupler 146. Preferably, each respective male coupler 142 and respective female coupler 146 comprises at least one strap portion, preferably comprising adjustable length strapping, preferably such adjustable mechanism being a simple strap adjuster, preferably integral to such respective male coupler 142 and respective female coupler 146, being structured and arranged to assist in at least one preferred strapping arrangement of the rescue sled 102 to strap an incapacitated, wounded or injured person(s) 106 to such rescue sled 102, as shown. Male coupler 142 and respective female coupler 146 preferably comprising high quality side release plastic buckles preferably comprising two or more prongs that spring outward to the sides of the buckle. When the male coupler 142 is inserted into the female coupler 146 the prongs latch onto the female coupler 146 holding it securely, as shown.

Figure 6:
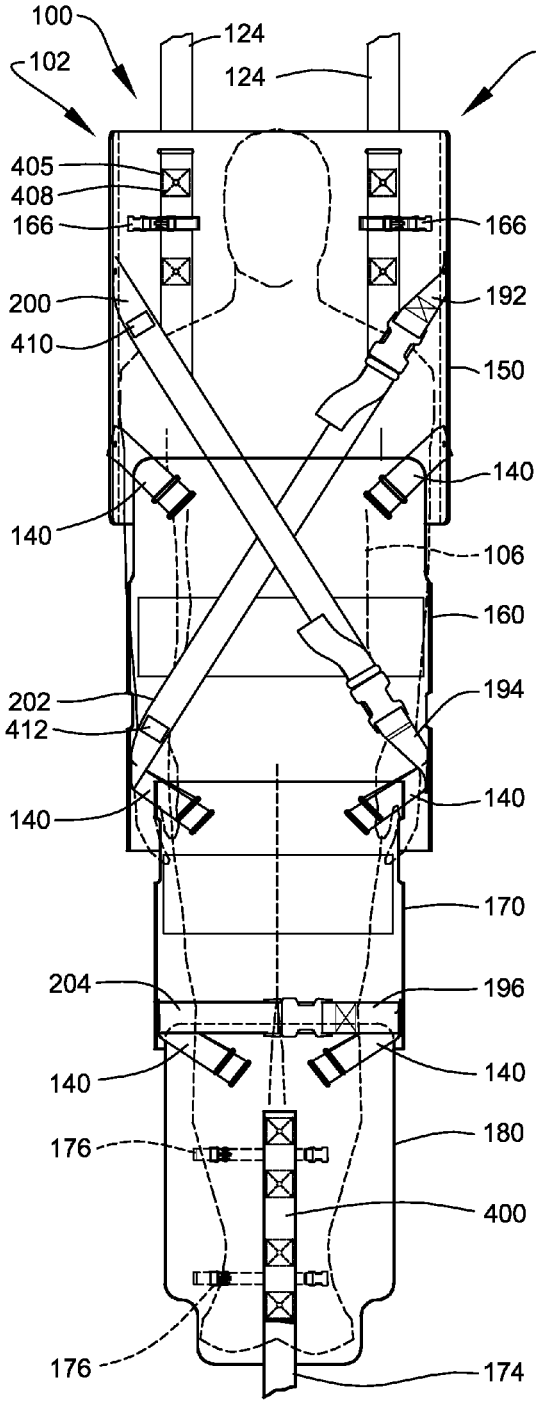
FIG. 6 shows a top view illustrating the rescue sled, in a deployed position, according to the preferred embodiment of FIG. 1.

Preferably, male couplers 142 intended to be inserted into a respective specific female coupler 146 are color coded to be easily matched up when securing an injured person 106. For example, respective couplers are preferably color-coded the same color for attachment of respective couplers on restraining strap 192 to respective couplers restraining strap 202; and, attachment of respective couplers on restraining strap 194 to respective couplers restraining strap 200, as shown in FIG. 6. Such color-coding is particularly valuable in emergency situations when time is of the essence to saving a life. Upon reading this specification, those with ordinary skill in the art will now appreciate that, under appropriate circumstances, considering such issues as design preference, user preferences, marketing preferences, cost, structural requirements, available materials, technological advances, etc., other coding arrangements such as, for example, markings, indicia, etc., may suffice.

Preferably, at least second section (torso) 160 and third section (torso) 170 comprise a friction enhancer portion 164, preferably a non-slip surface preferably comprising rubber or other washable material. Friction enhancer portion 164 preferably is at least about four inches in width and preferably extends longitudinally about the entire width of the respective segment, as shown. Friction enhancer portion 164 preferably assisting keeping such incapacitated, wounded or injured person(s) 106 on the rescue sled 102, when so placed, as shown. Upon reading this specification, those with ordinary skill in the art will now appreciate that, under appropriate circumstances, considering such issues as design preference, user preferences, marketing preferences, cost, structural requirements, available materials, technological advances, etc., other friction enhancing arrangements such as, for example, foam material, plastic materials, ridges, bumps, etc., may suffice.

Further, during stowed position 110, straps 140 preferably are also stowed; as such, tie downs 166 are preferably placed at first section (head) 150 to hold at least carrying straps 124 on first section 150, as shown. Also, tie downs 176 are preferably placed at fourth section (leg) 180 to hold at least auxiliary carrying strap 174, as shown. Preferably, both tie downs 166 and tie downs 176 comprise a nylon fabric strap that may be adjusted and coupled together, preferably using male and female couplers, preferably smaller-sized, as shown.

Alternately preferably, strapping and tie downs 176 may be left off at fourth section (leg) 180, allowing an alternately preferable situation wherein an injured person's head may be placed at fourth section (leg) 180. In such alternate preference, a foam cushion strip 400 may be placed along the center portion of fourth section (leg) 180, generally over the bolt holes securing secondary carrying strap 174 (further shown in FIG. 6), as shown. Additionally, foam cushion strips 402 may be placed along the bolts portion securing carrying straps 124, as shown. Foam cushion strip 400 and foam cushion strips 402 preferably replaceable and preferably comprising about a quarter-inch thick dense foam, as shown (see also FIG. 19). Upon reading this specification, those with ordinary skill in the art will now appreciate that, under appropriate circumstances, considering such issues as design preference, user preferences, marketing preferences, cost, structural requirements, available materials, technological advances, etc., other cushioning arrangements such as, for example, removable cushions, replaceable cushions, peel and stick cushion portions, hook and loop adhering cushion portions, etc., may suffice.

FIG. 6 shows a top view illustrating the rescue sled 102, in a deployed position 120, according to the preferred embodiment of FIG. 1. FIG. 6 illustrates a preferred positioning of an incapacitated, wounded or injured person(s) 106 on rescue sled 102. FIG. 6 further illustrates at least one example of an injured person 106 strapped to the rescue sled 102. When so positioned and strapped into place, injured person 106 assists providing at least one longitudinal support stabilizer to assist longitudinal stability of segmented sections 130, particularly during transport; even though such segmented section arrangements allow for flexible movement inter-segmentally (and as such assist emergency rescue over and through a variety of environments). The above described arrangement at least embodies herein at least one stability provider structured and arranged to provide longitudinal stability to said at least one support provider; wherein said at least one body securer and said at least one support provider, when coupled with the at least one incapacitated person, together comprise said at least one stability provider.

Preferably, as described above, a respective length of restraining strapping is on respective segmented section 130 along the rescue sled 102, as shown. Restraining strapping is preferably secured at bolting locations as shown and described herein and, preferably comprises heavy stitching around the perimeter of the bolting location in a preferably "square" pattern 405 further comprising a crossing "X" pattern 408, as shown (this arrangement later referred to herein as square X stitched 434).

Lengths of restraining strapping can vary however, for example, according to a preferred embodiment of the present invention, preferred lengths for the following restraining strapping and respective strapping positions (as shown) are as follows:

Restraining strap 192—about 10 inches, preferably folded in about half and attached to side rail 152A so as to provide about a 5-inch distance from side rail 152A.

Restraining strap 194—about 10-12 inches, preferably folded in about half and attached to side rail 162A so as to provide about a 5-inch distance from side rail 162A.

Restraining strap 196—about 10-12 inches, preferably folded in about half and attached to side rail 178A so as to provide about a 5-inch distance from side rail 178A.

Restraining strap 198—about 18 inches, preferably having a male coupler 142 on one end to adjoin to a female coupler 146 affixed in the center of fourth section (leg) 180, as shown.

Restraining strap 200—about 58-60 inches in length preferably attached to side rail 152B, as shown.

Restraining strap 202—about 58-60 inches in length preferably attached to side rail 172B, as shown.

Restraining strap 204—about 24-26 inches in length preferably attached to side rail 178B, as shown Restraining strap 206—about 18-20 inches, preferably having a male coupler 142 on one end to adjoin to a female coupler 146 affixed in the center of fourth section (leg) 180, as shown.

Upon reading this specification, those with ordinary skill in the art will now appreciate that, under appropriate circumstances, considering such issues as design preference, user preferences, marketing preferences, cost, structural requirements, available materials, technological advances, etc., other restraining strap arrangements such as, for example, longer or shorter strapping, multiple strapping, other strapping methods, etc., may suffice.

Restraining strap 200 preferably further comprises at least one tie-down 410, preferably a portion of hook and loop fabric structured and arranged to assist tying off any extra portions of strapping material during transport and/or deployment. Additionally restraining strap 202 preferably further comprises at least one tie-down 412, preferably a portion of hook and loop fabric structured and arranged to assist tying off any extra portions of strapping material during transport and/or deployment.

Figure 7B:
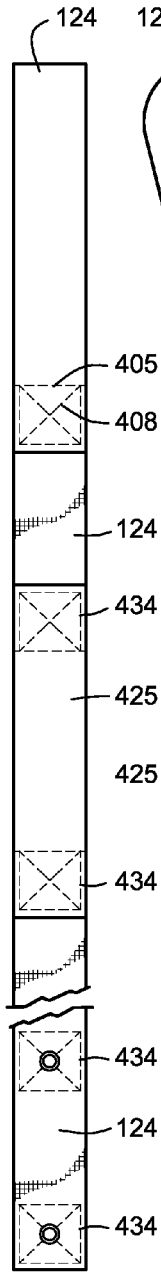
FIG. 7B shows a top diagrammatic view, illustrating the rescue sled carrying strap, according to the preferred embodiment of FIG. 7A.
Figure 7A:
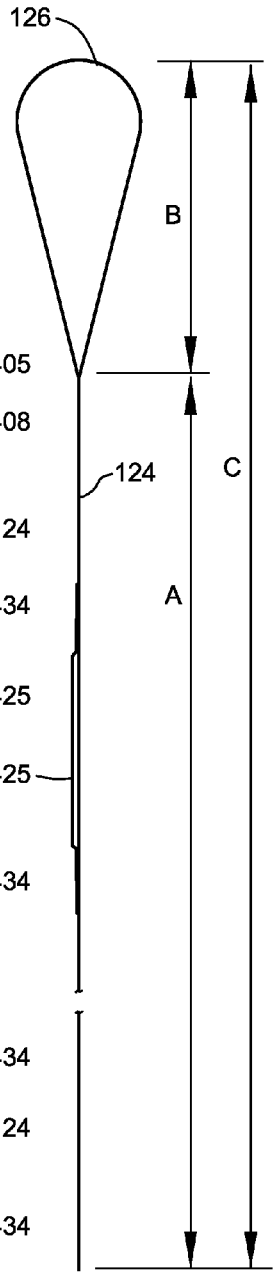
FIG. 7A shows a side diagrammatic view, illustrating the rescue sled carrying strap, according to the preferred embodiment of FIG. 1.

FIG. 7A shows a side diagrammatic view illustrating a rescue sled carrying strap 124, according to the preferred embodiment of FIG. 1. FIG. 7B shows a top diagrammatic view, illustrating the rescue sled carrying strap 124, according to the preferred embodiment of FIG. 7A.

Carrying strap 124 preferably comprises a length A of strap material, preferably seat-belt strength fabric strapping, preferably further comprising a looped portion 126, preferably extending a length B, as shown. Preferably, length A is about 46-48 inches and length B is about 28-30 inches resulting in an overall length C of carrying strap 124 of about 74-78 inches. Upon reading this specification, those with ordinary skill in the art will now appreciate that, under appropriate circumstances, considering such issues as design preference, user preferences, marketing preferences, cost, structural requirements, available materials, technological advances, etc., other carrying strap arrangements such as, for example, longer or shorter strap, cable, hand-grips, etc., may suffice.

Carrying strap 124 preferably further comprises at least one handholding gripping portion 425, as shown. Preferably, handholding gripping portion 425 comprises an extra length of seatbelt material, preferably about eight inches in length so that after being square X stitched 434 to carrying strap 124 (as shown) there is approximately a six inch portion wherein a hand may be slipped between the two so that another handholding gripping portion is provided, as shown. Upon reading this specification, those with ordinary skill in the art will now appreciate that, under appropriate circumstances, considering such issues as design preference, user preferences, marketing preferences, cost, structural requirements, available materials, technological advances, etc., other handholding gripping portion arrangements such as, for example, multiple handle portions, etc., may suffice.

Figures 8, 9, 10:
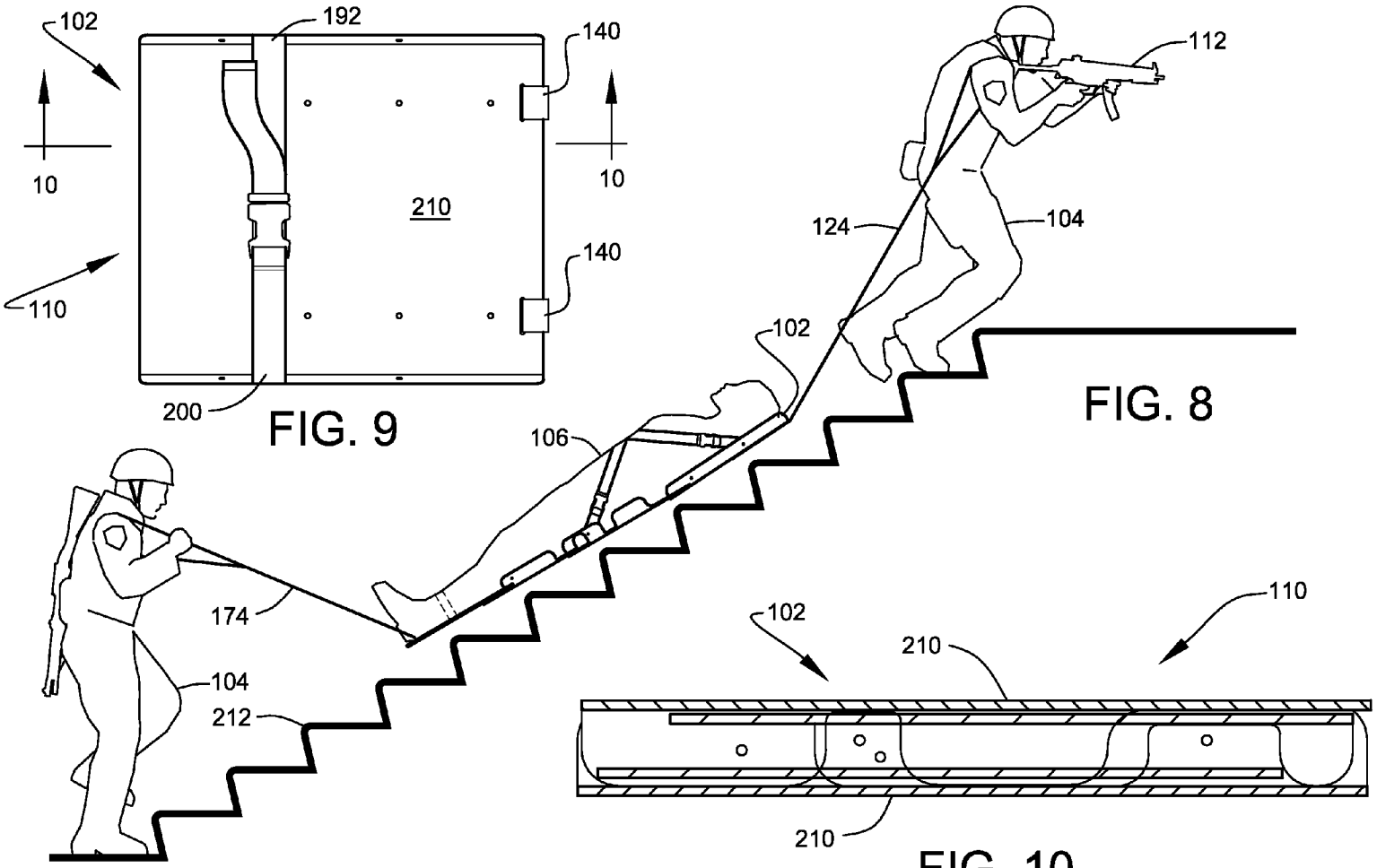
FIG. 8 shows a side view of a preferred method of using the rescue sled to transport an injured person over stairs, according to another preferred embodiment of the present invention.
FIG. 9 shows a top view of the rescue sled in a stowed position, according to another preferred embodiment of the present invention.
FIG. 10 shows a section view through section 10-10 of FIG. 9.

FIG. 8 shows a side view of a preferred method of using the rescue sled 102 to transport an incapacitated, wounded or injured person(s) 106 on the rescue sled 102 over stairs, according to another preferred embodiment of the present invention. The rescue sled 102 preferably comprises at least one secondary carrying strap 174 which preferably is utilized to assist transport of an incapacitated, wounded or injured person(s) 106 on the rescue sled 102 over stairs 212, or other uneven surfaces such as, for example, uneven ground, as shown. Further, segmented sections 130 assist the rescue sled 102 to more easily be maneuvered around corners. Preferably, upon placing the incapacitated, wounded or injured person(s) 106 onto the rescue sled 102 a first rescuer 104 utilizes carrying strap 124 to lift the head portion of the rescue sled 102 while a second rescuer 104 utilizes secondary carrying strap 174 to lift the foot portion of rescue sled 102, and complete transport over the stairs, as shown. Upon reading this specification, those with ordinary skill in the art will now appreciate that, under appropriate circumstances, considering such issues as design preference, user preferences, marketing preferences, cost, structural requirements, available materials, technological advances, etc., other transport arrangements such as, for example, use to transport goods, or ammunition, difficult-to-carry materials, etc., may suffice.

FIG. 9 shows a top view of the rescue sled 102 in a stowed position 110, according to another preferred embodiment of the present invention. FIG. 10 shows a section view through section 10-10 of FIG. 9. FIG. 9 and FIG. 10 illustrate placement of rescue sled 102 into the stowed position 110. Preferably, the multiple strap portions of rescue sled 102 are wrapped and/or stowed so that as the rescue sled 102 is folded into the configuration shown in FIG. 10, all the strap portions are held in the void created by side rails during the folding process, as shown. Further, tie downs 166 are preferably used to assist stowing carrying straps 124 and tie downs 176 are used to stow secondary carrying strap 174, as shown. Upon reading this specification, those with ordinary skill in the art will now appreciate that, under appropriate circumstances, considering such issues as design preference, user preferences, marketing preferences, cost, structural requirements, available materials, technological advances, etc., other stowing arrangements such as, for example, hook and loop fabrics, use of the male and female couplers, etc., may suffice.

Preferably, restraining strap 200 and restraining strap 192 are utilized on the exterior 210 of rescue sled 102 in the stowed position 110 to assist keeping the rescue sled 102 in the stowed position 110 and for use to carry the rescue sled 102 during initial carrying into the field for rescue, as shown.

Preferred measurements of a preferred embodiment of the present invention are described below and in conjunction with the following drawings, as shown.

Figure 11A:
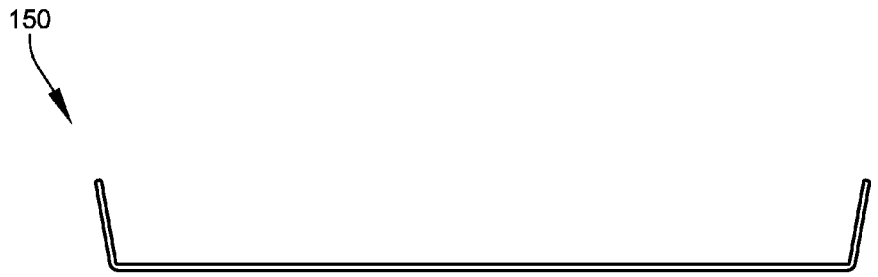
FIG. 11A shows an end view of a first section (head) of the rescue sled, according to the preferred embodiment of FIG. 1.
Figure 11B:
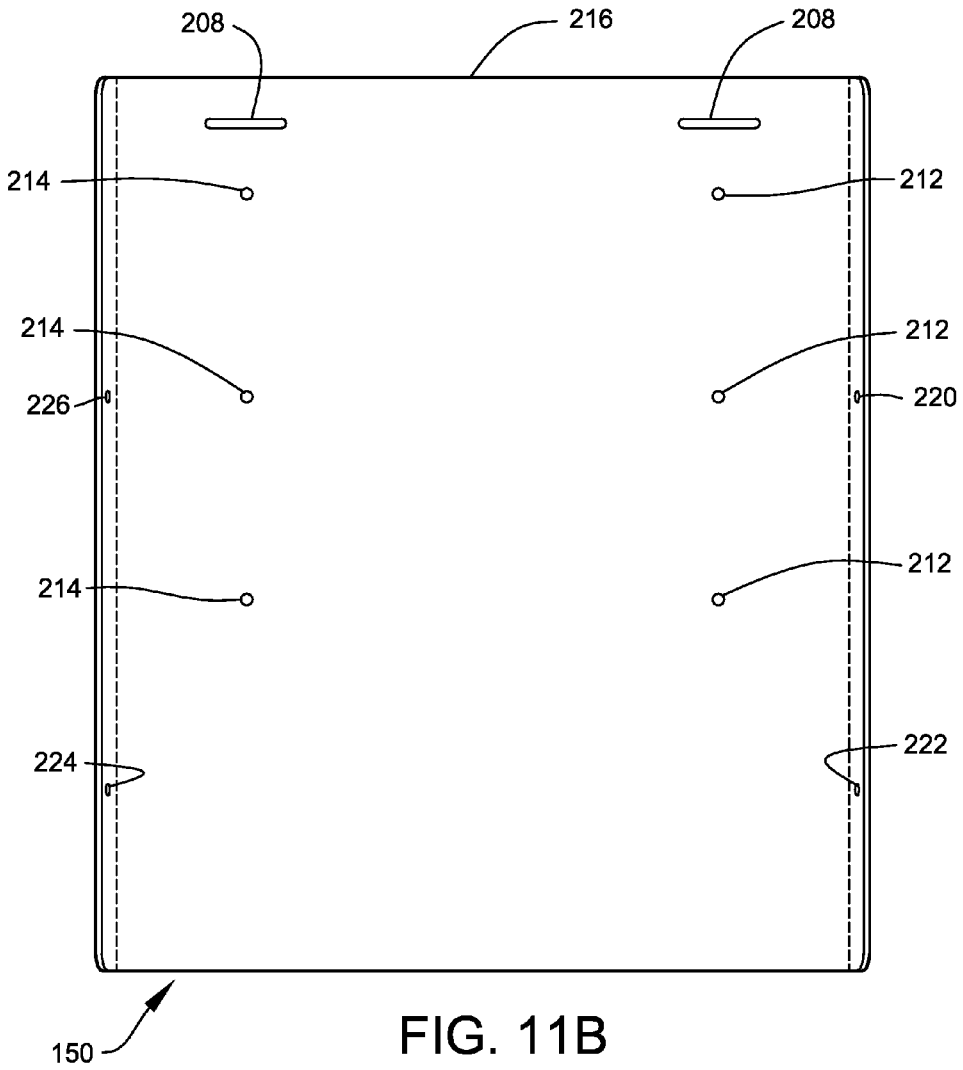
FIG. 11B shows a top view of a first section (head) of the rescue sled, according to the preferred embodiment of FIG. 1.
Figure 15A:
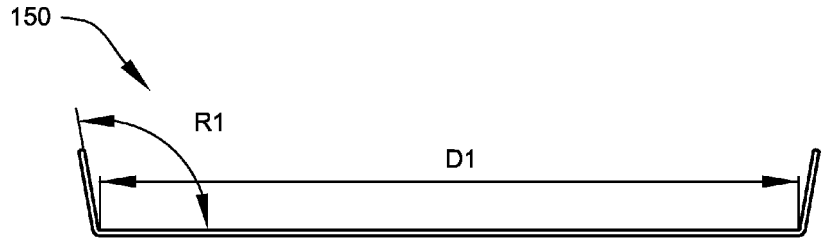
FIG. 15A shows an end view of the first section (head) of the rescue sled, according to the preferred embodiment of FIG. 11.
Figure 15B:
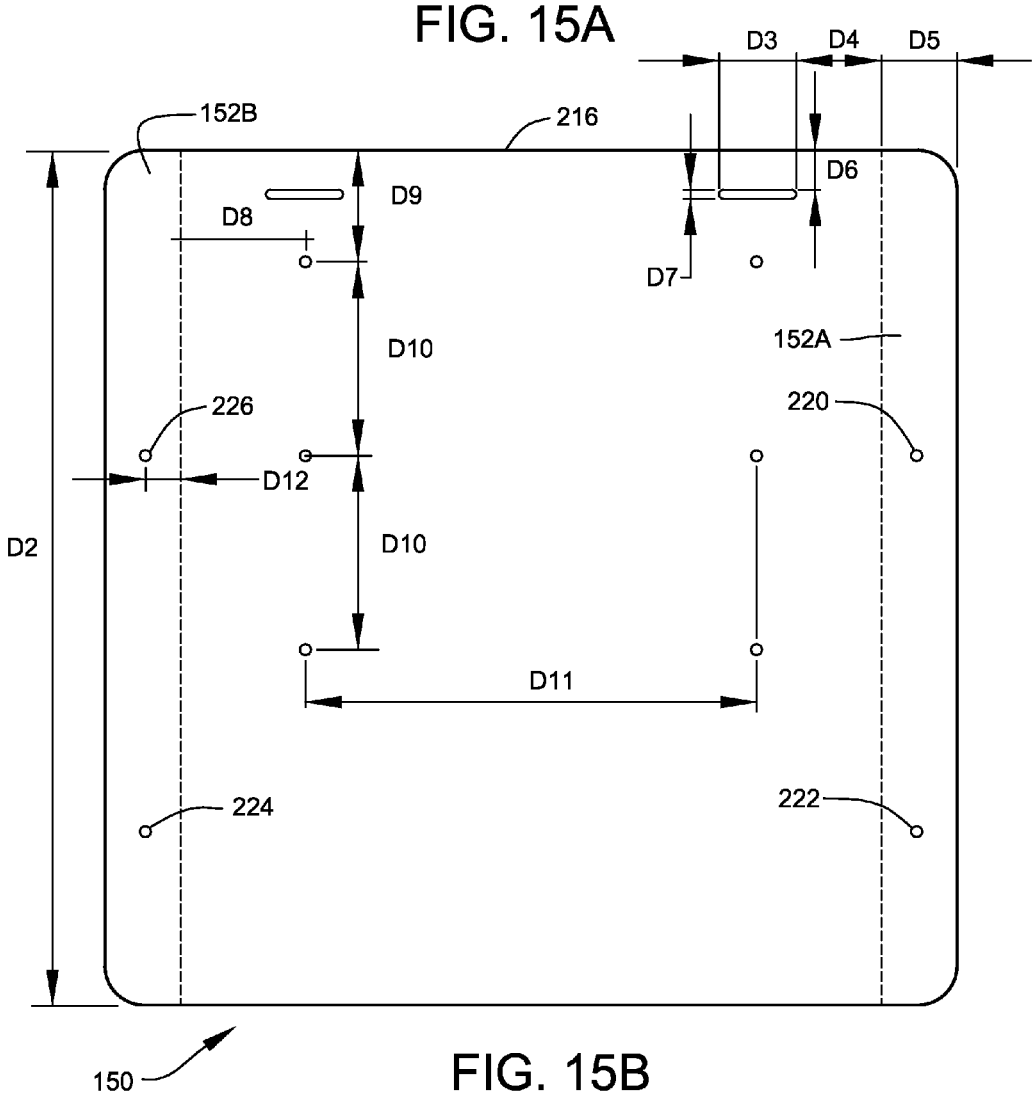
FIG. 15B shows a top diagrammatic pattern view of the first section (head) of the rescue sled, according to the preferred embodiment of FIG. 11.

FIG. 11A shows an end view of a first section (head) 150 of the rescue sled 102, according to the preferred embodiment of FIG. 1. FIG. 11B shows a top view of a first section (head) 150 of the rescue sled 102, according to the preferred embodiment of FIG. 1. FIG. 15A shows an end view of the first section (head) 150 of the rescue sled 102, according to the preferred embodiment of FIG. 11A and FIG. 11B. FIG. 15B shows a top diagrammatic pattern view of the first section (head) 150 of the rescue sled 102, according to the preferred embodiment of FIG. 11A and FIG. 11B. Preferably, first section (head) 150 comprises slotted openings 208 preferably about parallel with end 216, as shown. Slotted openings 208 preferably assist the threading of carrying straps 124, as shown in FIG. 4. Further, first section (head) 150 preferably comprises apertures 212 and 214, preferably structured and arranged to assist bolting of carrying straps 124, as shown. Preferably, apertures 212 and 214 are positioned parallel to each other, in about a mirrored position to each other, as shown. Apertures 212 and 214 comprise a diameter of about one-quarter inch which may vary depending on the preferred fastener width. First section (head) 150 further comprises aperture 220 which assists bolting of restraining strap 192, to side rails 152A (see FIG. 4). First section (head) 150 further comprises aperture 222 which assists bolting of strap 140, to side rail 152A (see FIG. 4). First section (head) 150 further comprises aperture 226 which assists bolting of restraining strap 200, to side rails 152B (see FIG. 4). First section (head) 150 further comprises aperture 224 which assists bolting of strap 140, to side rails 152B (see FIG. 4).

Preferred first section (head) 150 dimensions in inches are as follows:

D1 preferably is 17 inches
D2 preferably is 21 inches
D3 preferably is 1.875 inches
D4 preferably is 2 inches
D5 preferably is 2 inches
D6 preferably is 1 inch
D7 preferably is 0.187 inches (width of slot 208)
D8 preferably is 3 inches
D9 preferably is 2.75 inches
D10 preferably is 4.75 inches
D11 preferably is 11 inches
D12 preferably is 1 inch
R1 preferably comprises a radius of 100-degrees Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, larger or smaller, wider or less wide, longer or shorter, etc., may suffice.

Figure 12A:
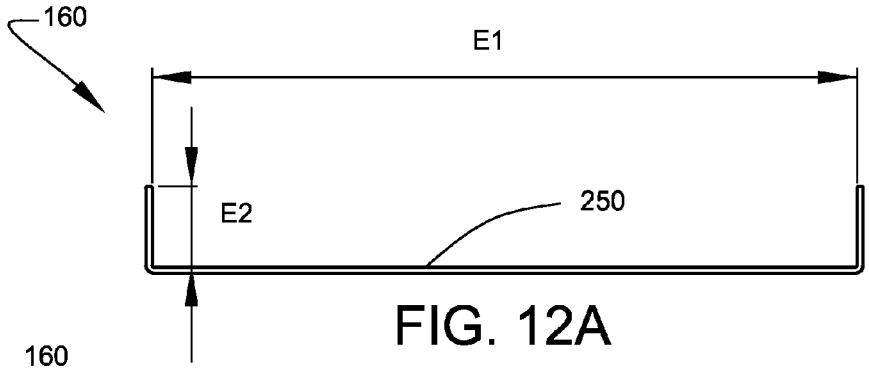
FIG. 12A shows an end view of a second section (torso) of the rescue sled, according to the preferred embodiment of FIG. 1.
Figure 12B:
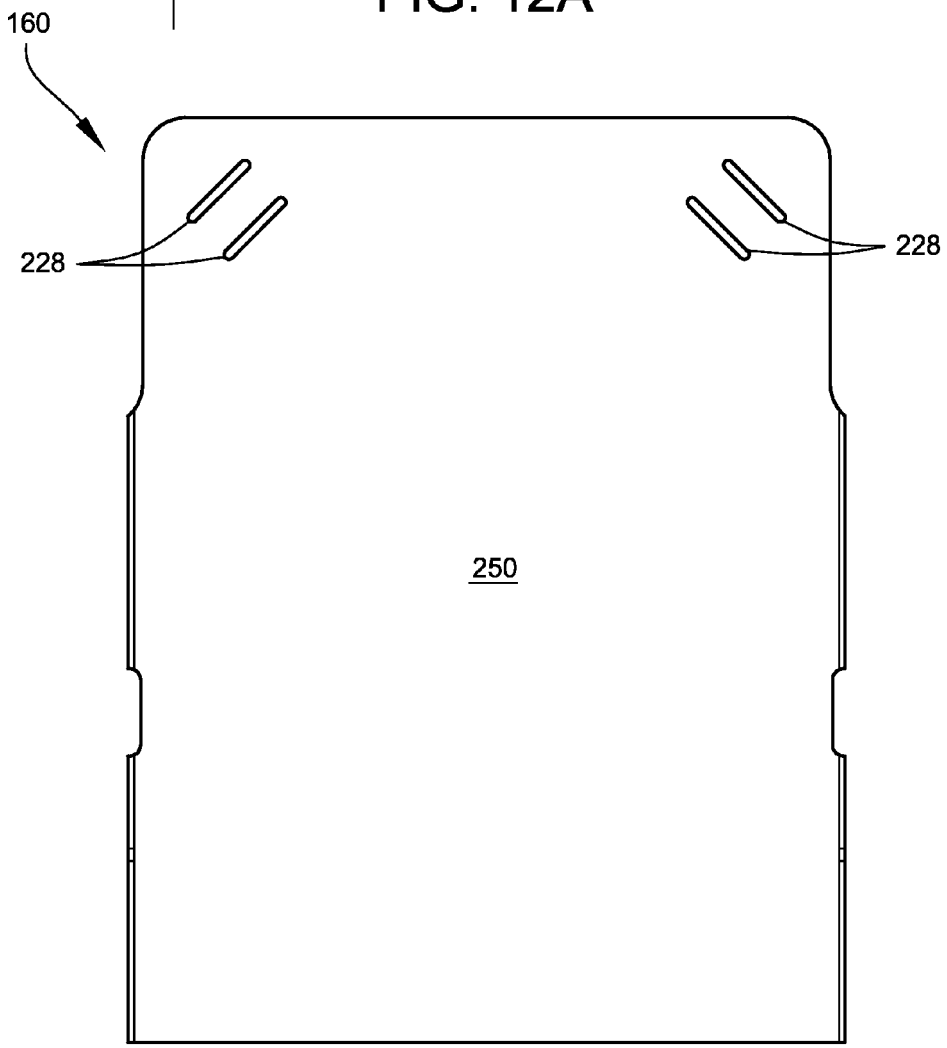
FIG. 12B shows a top view of a second section (torso) of the rescue sled, according to the preferred embodiment of FIG. 1.
Figure 16A:
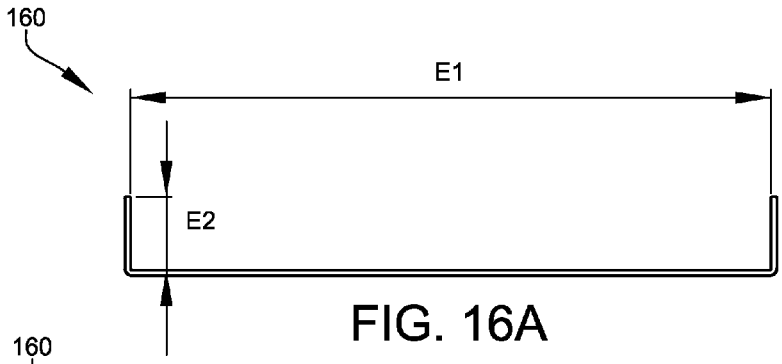
FIG. 16A shows an end view of the second section (torso) of the rescue sled, according to the preferred embodiment of FIG. 12.
Figure 16B:
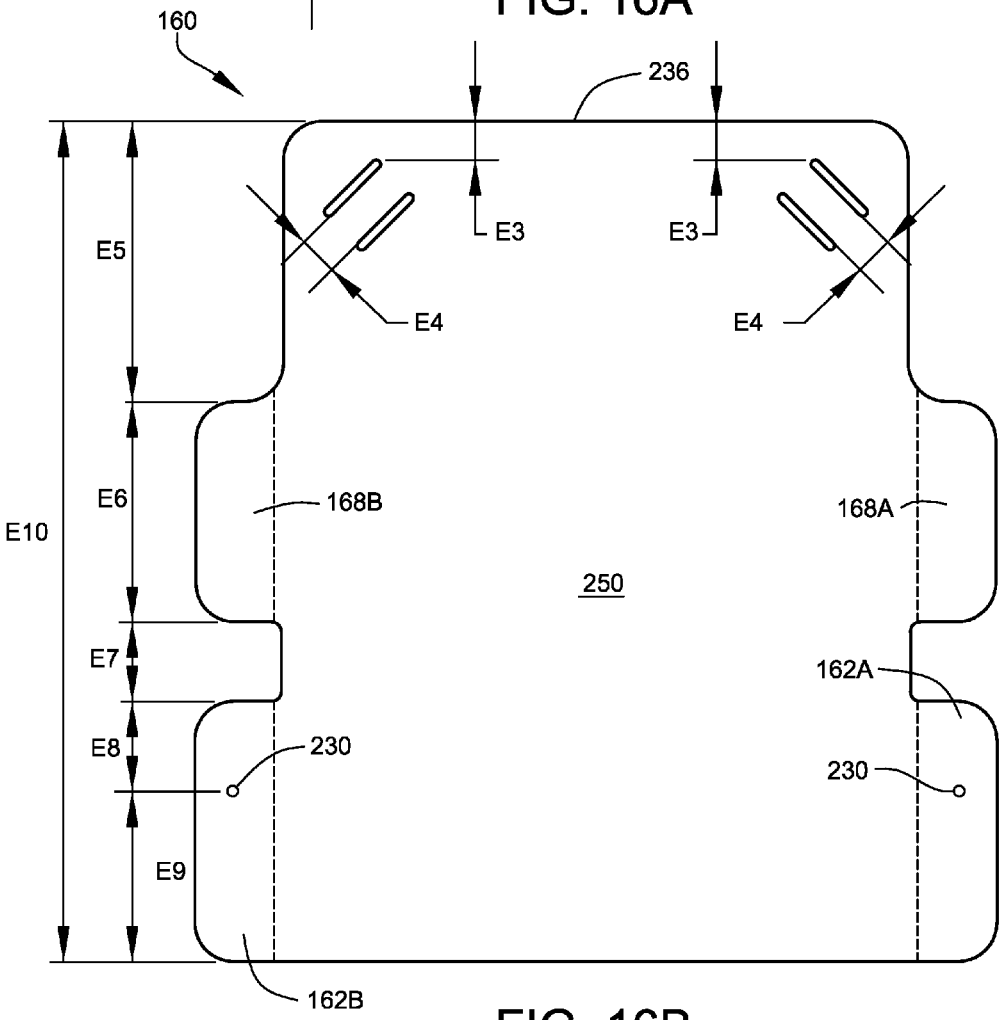
FIG. 16B shows a top diagrammatic pattern view of the second section (torso) of the rescue sled, according to the preferred embodiment of FIG. 12.

FIG. 12A shows a side view of a second section (torso) 160 of the rescue sled 102, according to the preferred embodiment of FIG. 1. FIG. 12B shows a top view of a second section (torso) 160 of the rescue sled 102, according to the preferred embodiment of FIG. 1. FIG. 16A shows an end view of the second section (torso) 160 of the rescue sled 102, according to the preferred embodiment of FIG. 12A and FIG. 12B. FIG. 16B shows a top diagrammatic pattern view of the second section (torso) 160 of the rescue sled 102, according to the preferred embodiment of FIG. 12A and FIG. 12B.

Second section (torso) 160 preferably comprises slotted openings 228 preferably angled at about 45-degree to end 236, as shown. Slotted openings 228 preferably assist the threading of straps 140, as shown in FIG. 4. Second section (torso) 160 preferably further comprises apertures 230 which assist bolting of restraining straps 202 and 194 to side rails 162A and 162B respectively, as shown in FIG. 4. Side rails 168A and 168B are preferably about perpendicular to the base 250 of second section (torso) 160, as shown.

Preferred second section (torso) 160 dimensions in inches are as follows:

E1 preferably is 16 inches
E2 preferably is 1.875 inches
E3 preferably is 1 inch
E4 preferably is 1 inch
E5 preferably is 7 inches
E6 preferably is 5.5 inches
E7 preferably is 2 inches
E8 preferably is 6.5 inches
E9 preferably is 4.25 inches
E10 preferably is 21 inches Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, larger or smaller, etc., may suffice.

Figure 13A:
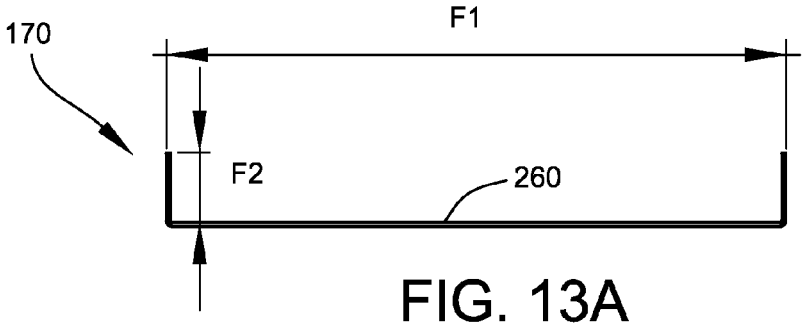
FIG. 13A shows an end view of a third section (torso) of the rescue sled, according to the preferred embodiment of FIG. 1.
Figure 13B:
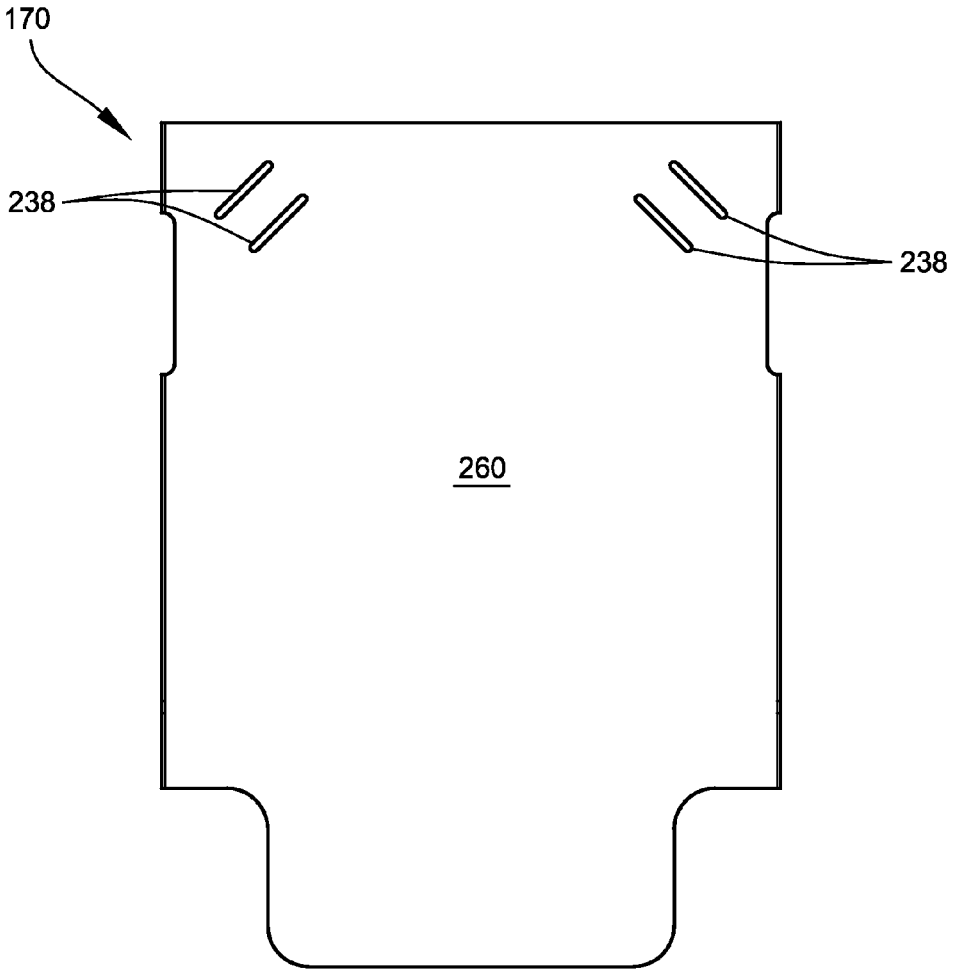
FIG. 13B shows a top view of a third section (torso) of the rescue sled, according to the preferred embodiment of FIG. 1.
Figure 17A:
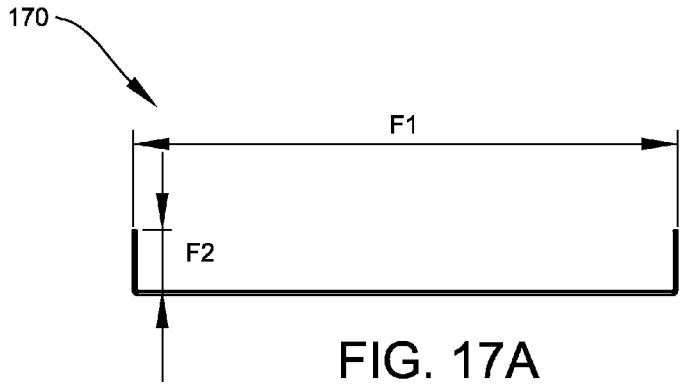
FIG. 17A shows an end view of the third section (torso) of the rescue sled, according to the preferred embodiment of FIG. 13.
Figure 17B:
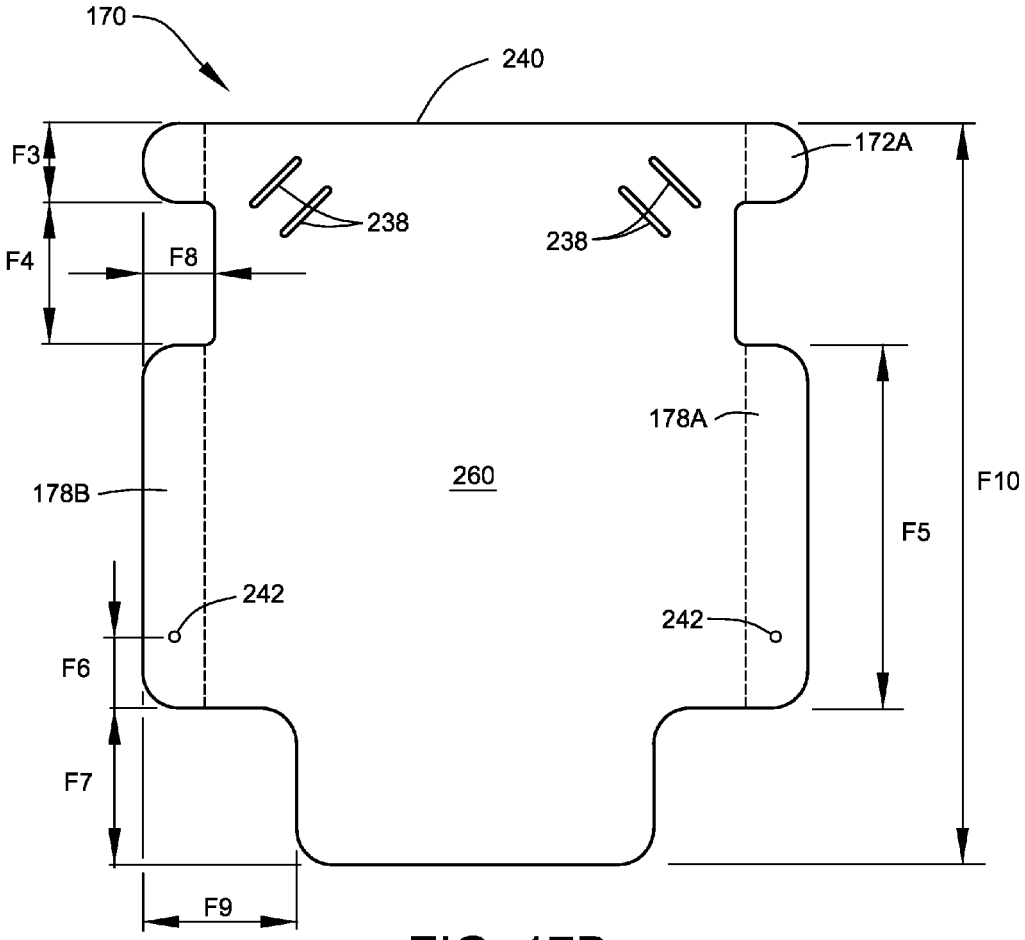
FIG. 17B shows a top diagrammatic pattern view of the third section (torso) of the rescue sled, according to the preferred embodiment of FIG. 13.

FIG. 13A shows a side view of a third section (torso) 170 of the rescue sled 102, according to the preferred embodiment of FIG. 1. FIG. 13B shows a top view of a third section (torso) 170 of the rescue sled 102, according to the preferred embodiment of FIG. 1. FIG. 17A shows an end view of the third section (torso) of the rescue sled, according to the preferred embodiment of FIG. 13A and FIG. 13B. FIG. 17B shows a top diagrammatic pattern view of the third section (torso) of the rescue sled, according to the preferred embodiment of FIG. 13A and FIG. 13B.

Third section (torso) 170 preferably comprises slotted openings 238 preferably angled at about 45-degree to end 240, preferably situate in the same relative location and dimension as second section (torso) 160, as shown. Slotted openings 238 preferably assist the threading of straps 140, as shown in FIG. 4. Third section (torso) 170 preferably further comprises apertures 242 which assists bolting of restraining straps 204 and 196 to side rails 178A and 178B respectively, as shown in FIG. 4. Side rails 178A and 178B are preferably about perpendicular to the base 260 of third section (torso) 170, as shown.

Preferred third section (torso) 170 dimensions in inches are as follows:

F1 preferably is 15 inches
F2 preferably is 1.75 inches
F3 preferably is 2.25 inches
F4 preferably is 4 inches
F5 preferably is 10.25 inches
F6 preferably is 2 inches
F7 preferably is 4.5 inches
F8 preferably is 1.75 inches
F9 preferably is 4.25 inches
F10 preferably is 21 inches Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, larger or smaller, etc., may suffice.

Figure 14:
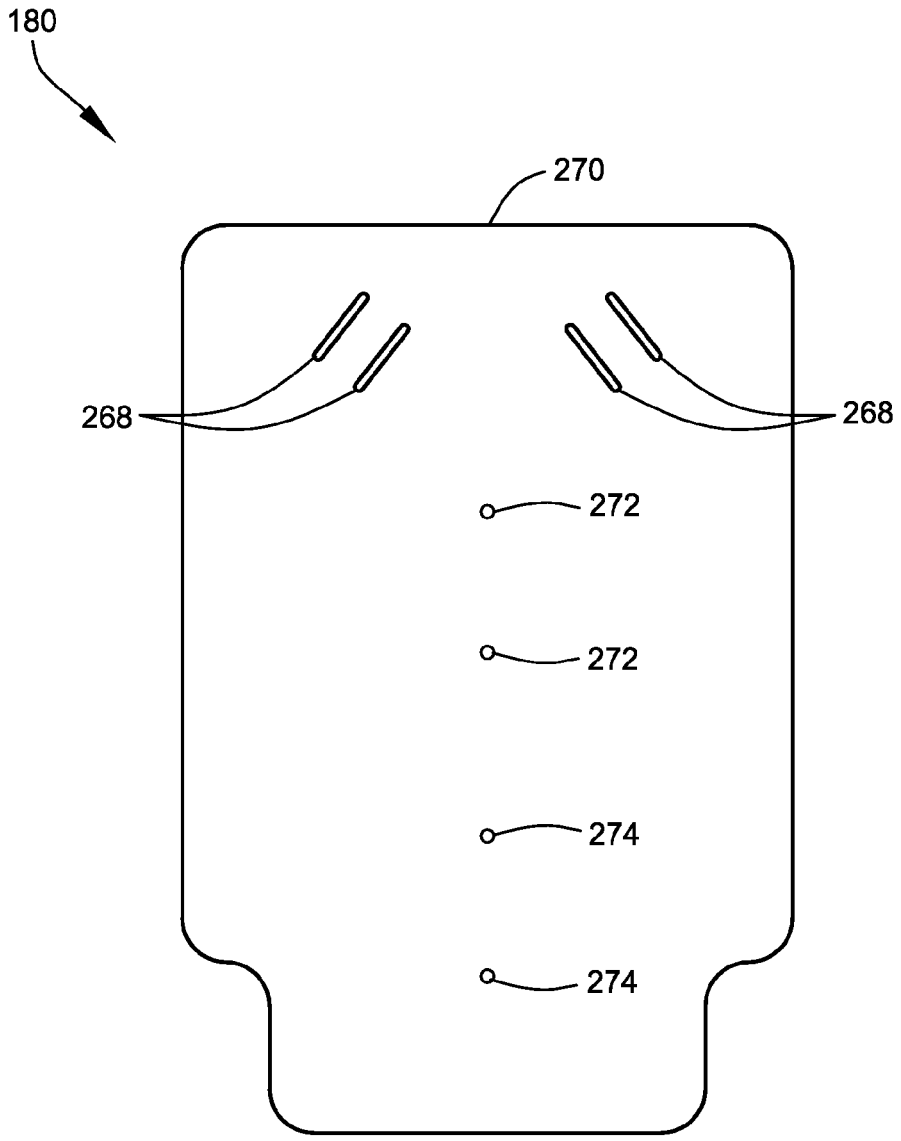
FIG. 14 shows a top view of a fourth section (leg) of the rescue sled, according to the preferred embodiment of FIG. 1.
Figure 18:
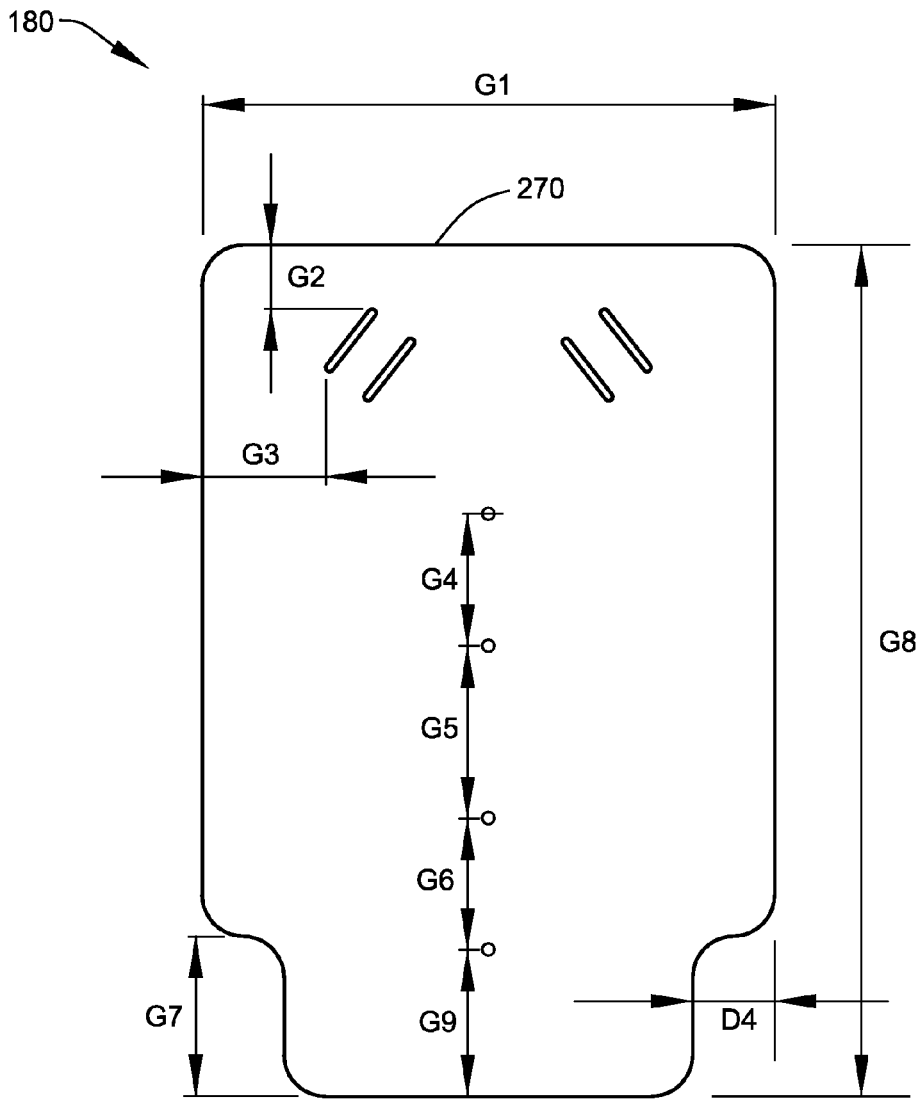
FIG. 18 shows a top diagrammatic pattern view of the fourth section (leg) of the rescue sled, according to the preferred embodiment of FIG. 14.

FIG. 14 shows a top view of a fourth section (leg) 180 of the rescue sled 102, according to the preferred embodiment of FIG. 1. FIG. 18 shows a top diagrammatic pattern view of the fourth section (leg) 180 of the rescue sled 102, according to the preferred embodiment of FIG. 14. Preferably, fourth section (leg) 180 comprises slotted openings 268 preferably angled at about 45-degrees to end 270, as shown. Slotted openings 268 preferably assist the threading of straps 140, as shown in FIG. 4. Further, fourth section (leg) 180 preferably comprises apertures 272 and 274, preferably structured and arranged to assist bolting of secondary carrying strap 174, as shown in FIG. 4.

Preferred fourth section (leg) 180 dimensions in inches are as follows:

G1 preferably is 14 inches
G2 preferably is 1.58 inches
G3 preferably is 3 inches
G4 preferably is 3.25 inches
G5 preferably is 4.25 inches
G6 preferably is 3.25 inches
G7 preferably is 4 inches
G8 preferably is 21 inches
G9 preferably is 3.75 inches Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, larger or smaller, etc., may suffice.

Figure 19:
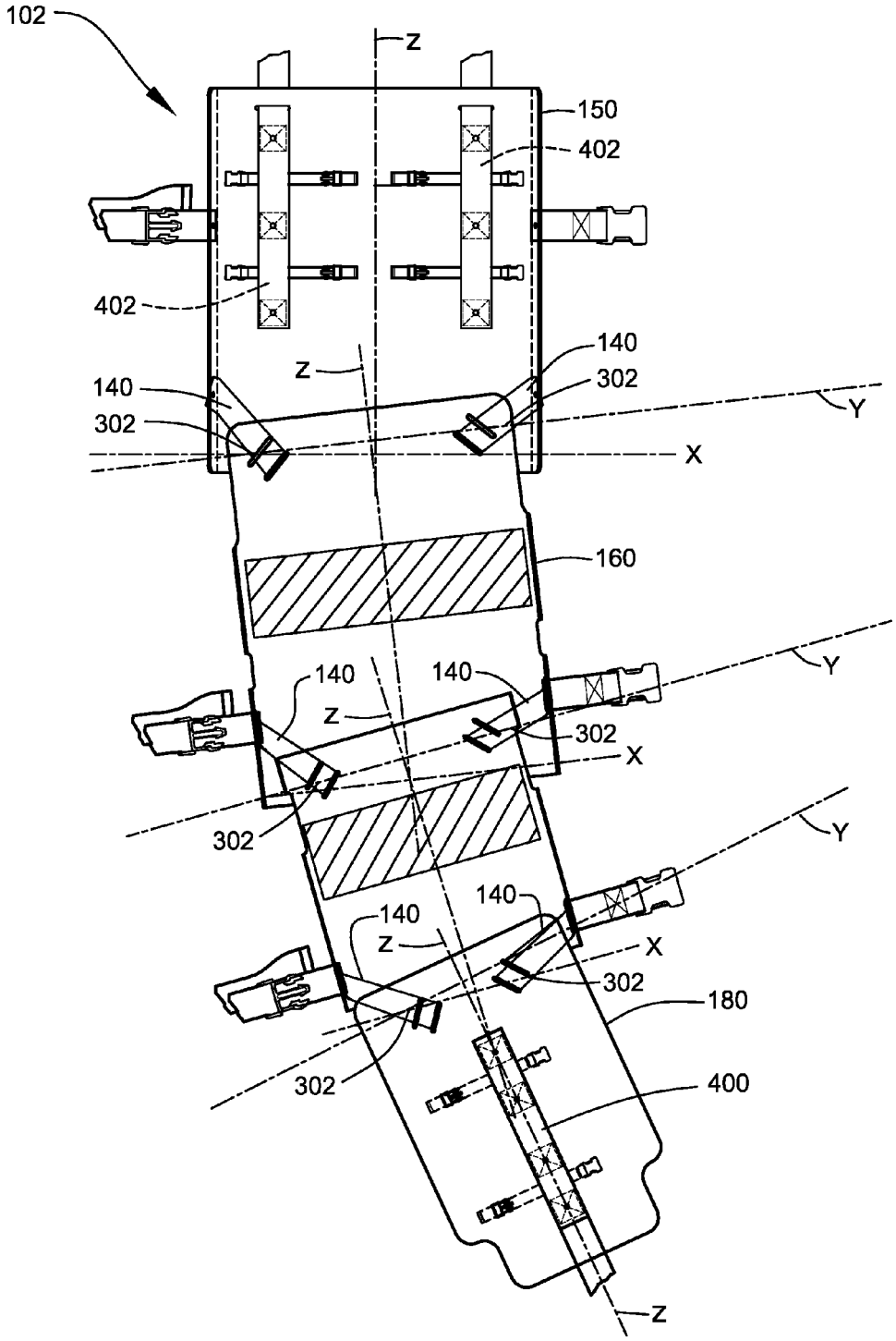
FIG. 19 shows a top view illustrating multiple-axis movement capabilities of the rescue sled, according to preferred embodiments of the present invention.

FIG. 19 shows a top view illustrating multiple-axis movement capabilities of the rescue sled 102, according to preferred embodiments of the present invention. Each respective segmented section 130 is preferably hinged to each respective adjacent segmented section 130, preferably loosely hinged, preferably using a pair of opposed straps 140, preferably at least seatbelt-strength-fabric straps 140 (at least embodying herein wherein said at least one flexible if strap comprises seat-belt strength flexible strap), preferably about 1⅞ inch in width, as shown (this arrangement at least embodying herein wherein said at least one flexible strap at least serially connects adjacent said segments). For example, first section (head) 150 is preferably coupled by straps 140 to second section (torso) 160 which is preferably coupled by straps 140 to third section (torso) 170 which is preferably coupled by straps 140 to fourth section (leg) 180, as shown. Such use of flexible fabric straps 140 for hinging provides for a set of multi-axis pivots 302 structured and arranged to assist pivoting of adjacent segmented sections 130, as shown (this arrangement at least embodying herein wherein said at least one multi-axis pivot comprises at least one flexible strap structured and arranged to flexibly couple adjacent said segments). Preferably, each respective pair of multi-axis pivots 302 provides for movement of adjacent segmented sections 130 to move in at least one first direction along at least one first axis X (at least embodying herein said at least one multi-axis pivot is structured and arranged to assist pivoting of adjacent said segments around at least one first axis in at least one first direction) preferably about perpendicular to a longitudinal central axis Z, preferably between about zero degrees and about one-hundred-eighty degrees, such as, for example, when the respective adjacent segmented sections 130 are folded in a nested stowed position 110. The above described arrangement at least embodies herein wherein said plurality of segments comprises a series of single segments structured and arranged to allow geometric movement of a single segment of said plurality of segments relative to adjacent said single segments in series.

Further, each respective pair of multi-axis pivots 302 provides for movement of adjacent segmented sections 130 to move in at least one second direction along at least one axis Y (at least embodying herein said at least one multi-axis pivot is structured and arranged to assist pivoting of adjacent said segments around at least one second axis in at least one second direction) to provide respective adjacent sections to serpentine in a side-to-side movement such as, for example, when the respective adjacent segmented is rotated from about zero-degrees to about 45-degrees for a longitudinal central axis Z, preferably situate along a centre line of a respective segmented section 130, as shown. The above described arrangements and those illustrated on the drawings further at least embodying herein such at least one first direction is non-parallel to such at least one second direction.

The above described arrangement provides for a rescue sled system 100 that may be used to transport an injured person 106 within very narrow spaces such as, for example, a narrow hallway having multiple narrow corners wherein a rescuer 104 can pivot such rescue sled 102 up and down (along axis X) or left and right (along axis Y) to clear such narrow spaces more easily than for example, a solid backboard. In addition, the above described arrangement provides for a rescue sled system 100 that assists rescue and in uneven areas such as hills, stairs, trenches, complex building structures, etc.

Although applicant has described applicant's preferred embodiment(s) of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A rescue sled system, relating to transport by at least one rescuer of at least one incapacitated person in at least one environment under emergency conditions, comprising:

a) at least one support provider, having a plurality of segments, structured and arranged to provide at least one support for the at least one incapacitated person during transport;

b) at least one segmental divider structured and arranged to divide said at least one support provider into said plurality of segments;

c) at least one segmental serial connector structured and arranged to serially connect said plurality of segments; and d) at least one body securer structured and arranged to secure the at least one incapacitated person to said at least one support provider;

e) wherein said plurality of segments serially connected comprise a series of single segments structured and arranged to allow geometric movement of a respective said segment of said plurality of segments relative to adjacent said segments in series; and f) wherein said at least one support provider further comprises i) at least one deployed configuration structured and arranged to support substantially a full body length of the at least one incapacitated person, and ii) at least one stowed configuration comprising at least one reduced physical formation structured and arranged to assist body-supported transport of said at least one support provider, iii) wherein at least one rescuer may body-supported transport said at least one support provider in said at least one stowed configuration, deploy said at least one support provider in said at least one deployed configuration and transport the at least one incapacitated person; and g) at least one forward pull strap structured and arranged to assist such transport of the at least one incapacitated person by the application of at least one pulling force on said at least one support provider;

h) wherein said at least one forward pull strap comprises at least one first body engager structured and arranged to engage the body of at least one first rescuer to assist such pulling; and i) at least one trailing lift strap structured and arranged to assist such transport of the at least one incapacitated person by the application of at least one lifting force on said at least one support provider;

j) wherein said at least one trailing lift strap comprises at least one second body engager structured and arranged to engage the body of at least one second rescuer; and k) wherein said plurality of segments further comprises i) at least one leading segment associated with support of a head region of the at least one incapacitated person, and ii) at least one trailing segment associated with support of a foot region of the at least one incapacitated person; and 1) at least one intermediate segment disposed between said at least one leading segment and said at least one trailing segment;

m) wherein said at least one trailing segment is configured to be arrangeable in at least one compact nested position adjacent said at least one intermediate segment;

n) wherein said at least one intermediate segment is configured to be arrangeable in at least one compact nested position adjacent said at least one leading segment; and o) wherein when said at least one trailing segment is in at least one compact nested position adjacent said at least one intermediate segment and, said at least one intermediate segment is in the at least one compact nested position adjacent said at least one leading segment, said at least one stowed configuration is achieved.

2. The rescue sled system, according to claim 1, wherein said at least one support provider further comprises:

a) at least one stability provider structured and arranged to provide longitudinal stability to said at least one support provider;

b) wherein said at least one body securer and said at least one support provider, when coupled with the at least one incapacitated person, together comprise said at least one stability provider.

3. The rescue sled system, according to claim 1, wherein said at least one segmental serial connector comprises at least one multi-axis pivot structured and arranged to assist pivoting of adjacent said segments around at least one first axis and at least one second axis.

4. The rescue sled system, according to claim 3, wherein:

a) said at least one multi-axis pivot is structured and arranged to assist pivoting of adjacent said segments around at least one first axis in at least one first direction; and b) said at least one multi-axis pivot is structured and arranged to assist pivoting of adjacent said segments around at least one second axis in at least one second direction; and c) such at least one first direction is non-parallel to such at least one second direction.

5. The rescue sled system, according to claim 4, wherein:

a) said at least one multi-axis pivot comprises at least one flexible strap structured and arranged to flexibly couple adjacent said segments; and b) said at least one flexible strap at least serially connects adjacent said segments.

6. The rescue sled system, according to claim 5, wherein said at least one flexible strap comprises at least one seat-belt-strength flexible strap.

7. The rescue sled system, according to claim 5, wherein:

a) said at least one flexible strap is structured and arranged to permanently connect said segments; and b) each of said segments remains independently moveable relative to each other said segment when coupled.

8. The rescue sled system, according to claim 7, wherein said at least one flexible strap is structured and arranged to form at least one overlap portion between adjacent said segments to assist said at least one support provider to provide support continuity.

9. The rescue sled system, according to claim 1, wherein said least one support provider comprises four said segments, each said segments decreasing in transverse width from said at least one leading segment to said at least one trailing segment.

10. The rescue sled system, according to claim 1, wherein:

a) each said segment is arranged to overlap, and be partially supported by, a proceeding adjacent said segments; and b) said segments are overlapped in an orientation assisting sliding of said segments during transport of the at least one incapacitated person when pulled by said at least one leading segment.

11. The rescue sled system, according to claim 1, wherein:

a) said at least one forward pull strap is coupled to said at least one leading segment; and b) said at least one trailing lift strap is coupled to said at least one trailing segment.

12. The rescue sled system, according to claim 1, wherein at least one body securer further comprises at least one pair of opposed upwardly-projecting lateral walls structured and arranged to assist retention of the at least one incapacitated person during such transport.

13. A rescue sled system, relating to transport by at least one rescuer of at least one incapacitated person in at least one environment under emergency conditions, comprising:

a) at least one support provider, having a plurality of segments, structured and arranged to provide at least one support for the at least one incapacitated person during transport;

b) at least one segmental divider structured and arranged to divide said at least one support provider into said plurality of segments;

c) at least one segmental serial connector structured and arranged to serially connect said plurality of segments; and d) at least one body securer structured and arranged to secure the at least one incapacitated person to said at least one support provider;

e) wherein said plurality of segments comprises a series of single segments structured and arranged to allow geometric movement of a single segment of said plurality of segments relative to adjacent said single segments in series;

f) wherein said at least one support provider further comprises i) at least one deployed configuration structured and arranged to support substantially a full body length of the at least one incapacitated person, and ii) at least one stowed configuration comprising at least one reduced physical formation structured and arranged to assist body-supported transport of said at least one support provider;

g) wherein at least one rescuer may body-supported transport said at least one support provider in said at least one stowed configuration, deploy said at least one support provider in said at least one deployed configuration and transport the at least one incapacitated person;

h) at least one forward pull strap structured and arranged to assist such transport of the at least one incapacitated person by the application of at least one pulling force on said at least one support provider;

i) wherein said at least one forward pull strap comprises at least one first body engager structured and arranged to engage the body of at least one first rescuer to assist such pulling;

j) at least one trailing lift strap structured and arranged to assist such transport of the at least one incapacitated person by the application of at least one lifting force on said at least one support provider;

k) wherein said at least one trailing lift strap comprises at least one second body engager structured and arranged to engage the body of at least one second rescuer;

l) wherein said plurality of segments further comprises i) at least one leading segment associated with support of at least a head region of the at least one incapacitated person, ii) at least one trailing segment associated with support of at least a foot region of the at least one incapacitated person, iii) at least one intermediate segment disposed between said at least one leading segment and said at least one trailing segment, iv) wherein said at least one trailing segment is configured to be arrangeable in at least one compact nested position adjacent said at least one intermediate segment, v) wherein said at least one intermediate segment is configured to be arrangeable in at least one compact nested position adjacent said at least one leading segment, and vi) wherein when said at least one trailing segment is in at least one compact nested position adjacent said at least one intermediate segment and said at least one intermediate segment is in the at least one compact nested position adjacent said at least one leading segment, said at least one stowed configuration is achieved; and m) said at least one segmental serial connector comprises at least one multi-axis pivot structured and arranged to assist pivoting of adjacent said segments around at least one first axis and at least one second axis;

n) wherein said at least one multi-axis pivot is structured and arranged to assist pivoting of adjacent said segments around such at least one first axis;

o) wherein said at least one multi-axis pivot is structured and arranged to assist pivoting of adjacent said segments around such at least one second axis;

p) wherein such at least one second axis is non-parallel to such at least one first axis;

q) wherein said at least one multi-axis pivot comprises at least one flexible strap structured and arranged to flexibly couple adjacent said segments;

r) wherein said at least one flexible strap at least serially connects adjacent said segments;

s) wherein said at least one flexible strap is structured and arranged to permanently connect said segments; and t) wherein each of said segments remains independently moveable relative to each other said segment when coupled.

14. The rescue sled system, according to claim 13, wherein:

a) said least one support provider comprises four said segments, each said segments decreasing in transverse width from said at least one leading segment to said at least one trailing segment;

b) each said segment is arranged to overlap, and be partially supported by, a proceeding adjacent said segment; and c) said segments are overlapped in an orientation assisting sliding of said segments during transport of the at least one incapacitated person when pulled by said at least one leading segment.

15. The rescue sled system, according to claim 14, wherein at least one body securer further comprises:

a) at least one body strap structured and arranged to strap at least the torso of the at least one incapacitated person; and b) at least one foot strap structured and arranged to strap at least one lower leg portion of the at least one incapacitated person.

* * * * *